US006853116B2

(12) United States Patent
Hori et al.

(10) Patent No.: US 6,853,116 B2
(45) Date of Patent: Feb. 8, 2005

(54) STRUCTURE OF SPARK PLUG DESIGNED TO PROVIDE HIGHER DURABILITY AND IGNITABILITY OF FUEL

(75) Inventors: Tsunenobu Hori, Kariya (JP); Keiji Kanao, Aichi-ken (JP)

(73) Assignee: Denso Corporation (JP)

( * ) Notice: Subject to any disclaimer, the term of this patent is extended or adjusted under 35 U.S.C. 154(b) by 0 days.

(21) Appl. No.: 10/066,606

(22) Filed: Feb. 6, 2002

(65) Prior Publication Data

US 2002/0105254 A1 Aug. 8, 2002

(30) Foreign Application Priority Data

Feb. 8, 2001 (JP) ..... 2001-032475

(51) Int. Cl.[7] ..... H01T 13/20
(52) U.S. Cl. ..... 313/141; 313/143; 313/118
(58) Field of Search ..... 313/140, 141, 313/143, 118

(56) References Cited

U.S. PATENT DOCUMENTS 4,109,633 A 8/1978 Mitsudo et al.
5,811,915 A 9/1998 Abe et al.
5,977,695 A * 11/1999 Osamura et al. ..... 313/141
6,597,089 B2 * 7/2003 Matsutani ..... 313/141

FOREIGN PATENT DOCUMENTS

EP 0936710 A1 8/1999
EP 1049222 A1 11/2000
JP 52-36237 3/1977
JP 9-106880 4/1997
JP 11-354251 12/1999

OTHER PUBLICATIONS

U.S. Appl. No. 09/324,860 (corres. to JP 11–354251).

* cited by examiner

*Primary Examiner*—Joseph Williams
(74) *Attorney, Agent, or Firm*—Nixon & Vanderhye PC

(57) ABSTRACT

An improved structure of a spark plug which provides higher durability and ignitability of a gaseous fuel. The spark plug consists of a center electrode, a ground electrode, a noble metal chip joined to a center electrode-opposed surface of the ground electrode by laser welding, and a fused portion that forms a weld of the noble metal chip and the ground electrode formed by materials of the ground electrode and the noble metal chip melted together. A sectional area of the noble metal chip traversing a length thereof is between 0.1 $mm^2$ and 0.6 $mm^2$. An unfused sectional area percentage that is a percentage of a sectional area of an unfused portion of a joined end of the noble metal chip within a range of a sectional area of the noble metal chip closest to the fused portion traversing the length of the noble metal chip is less than or equal to 50%. A melt angle that is an angle which a line extending through the fused portion along a maximum depth of the fused portion makes with the center electrode-opposed surface of the ground electrode is less than or equal to 60°.

20 Claims, 23 Drawing Sheets

STRUCTURE OF SPARK PLUG DESIGNED TO PROVIDE HIGHER DURABILITY AND IGNITABILITY OF FUEL

BACKGROUND OF THE INVENTION

1. Technical Field of the Invention

The present invention relates generally to a spark plug which may be employed in automotive engines, and more particularly to an improved structure of a spark plug with a noble metal chip welded to a ground electrode for providing higher durability and ignitability of a gaseous fuel and a fabrication method therefor.

2. Background Art

Japanese Patent First Publication No. 52-36237 (corresponding to U.S. Pat. No. 4,109,633, issued on Aug. 29, 1978 to Mitsudo et al.) teaches a spark plug which consists of a center electrode and a ground electrode which project from electrode supports. The center and ground electrodes are thinner than the electrode support for improving the ignitability of an air-fuel mixture. This is based on the facts that the thinning of the center and ground electrodes results in an decrease in thermal capacity thereof, thereby reducing the effect of extinguishing a flame kernel and that the projection of the ground and center electrodes from the electrode support results in an increased space between the center and ground electrodes, thereby facilitating the growth of a flame kernel produced within a spark gap.

In order to ensure the wear resistance, the center and ground electrodes are formed by noble metal members which are made of Pt, Pd, Au, or alloy thereof and joined to the electrode supports. The publication teaches that such joining may be achieved by welding, pressing, or staking after pressing, but is silent about the details of the shape and structure of a weld of each of the electrodes to one of the electrode support.

In modern engines, a combustible atmosphere is elevated in temperature for increasing an output and reducing a fuel consumption and exhaust emissions. In this type of engine, a park plug is subjected to an intense heat, so that the temperature of center and ground electrodes is increased greatly. The electrodes, therefore, undergo a thermal stress and oxidation, which may cause noble metal chips to be removed from the center and ground electrodes. Particularly, such a problem is exacerbated in the ground electrode because it is closer to a plug housing or metal shell than the center electrode, so that the degree of heat dissipation from the ground electrode is lower, and it has a wider area exposed inside a combustion chamber, so that the temperature thereof is elevated higher than that of the center electrode.

In order to enhance the reliability of welding the noble metal chip to each of the ground and center electrodes, Japanese Patent First Publication No. 9-106880 (corresponding to U.S. Pat. No. 5,811,915, issued on Sep. 22, 1998 to Abe et al., assigned to the same assignee as that of this application) and Japanese Patent First Publication No. 11-354251 teach an improved welding method. The former discloses pressing the noble metal chip against each electrode to have a portion of the electrode surrounding the noble metal chip stand up and radiating a laser beam to the protuberant portion to join the noble metal to the electrode. The latter discloses placing the noble metal chip made of an Ir alloy on each electrode and radiating a laser beam from outside the noble metal chip.

The inventors of this application made several researches and found that the above two welding methods encounter the drawback in that when thin noble metal chips having, for example, a sectional area of a fraction of a square millimeter are used for increasing the ignitability of a gaseous fuel, it is difficult to ensure a desired mechanical strength of the weld of the noble metal chip, especially to the ground electrode because the degree of heat dissipation from the ground electrode is lower than the center electrode, so that the temperature thereof is elevated higher than that of the center electrode.

SUMMARY OF THE INVENTION

It is therefore a principal object of the invention to avoid the disadvantages of the prior art.

It is another object of the invention to provide a structure of a spark plug designed to improve the reliability of a weld of a noble metal chip to a ground electrode even if the noble metal chip is made of a thin member for increasing the ignitability of a gaseous fuel and also provide a fabrication method thereof.

According to one aspect of the invention, there is provided a higher durability spark plug which may be employed in automotive engines. The spark plug comprises: (a) a center electrode having a tip; (b) a ground electrode having a center electrode-opposed surface facing the tip of the center electrode; (c) a noble metal member having a given length and a first and a second end opposed to each other through the length, the noble metal member being joined at the first end to the center electrode-opposed surface of the ground electrode by laser welding so as to oppose the second end to the tip of the center electrode through a spark gap; and (d) a fused portion that forms a weld of the noble metal member and the ground electrode formed by materials of the ground electrode and the noble metal member melted together. A sectional area of the noble metal member traversing the length thereof is greater than or equal to 0.1 $mm^2$ and smaller than or equal to 0.6 $mm^2$. An unfused sectional area percentage that is a percentage of a sectional area of an unfused portion of the first end of the noble metal member within a range of a sectional area of the noble metal member closest to the fused portion traversing the length of the noble metal member is less than or equal to 50%. A melt angle that is an angle which a line extending through the fused portion along a maximum depth of the fused portion makes with the center electrode-opposed surface of the ground electrode is less than or equal to 60°.

In the preferred mode of the invention, if a point at which the line extending along the maximum depth of the fused portion intersects an outer surface of the fused portion is defined as an intersection F, and a distance between the intersection F and the center electrode-opposed surface of the ground electrode is defined as an intersection-to-surface distance y, the intersection F is located within a range of −0.2 mm to 0.3 mm where when the intersection F is located outside the center electrode-opposed surface of the ground electrode, the intersection-to-surface distance y is expressed in a plus value (+), and when the intersection F is located inside the center electrode-opposed surface of the ground electrode, the intersection-to-surface distance y is expressed in a minus value (−). The melt angle is less than or equal to (30+100y)°.

If the width of a portion of the noble metal member closest to the fused portion is defined as D, the maximum depth of the fused portion is less than or equal to 1.4D.

The noble metal member may be made from one of a first material containing a main component of 50 Wt % or more of Pt and an additive of at least one of Rh, Ir, Os, Ni, W, Pd, and Ru and a second material containing a main component of 50 Wt % or more of Ir and an additive of at least one of Rh, Pt, Os, Ni, W, Pd, and Ru.

According to the second aspect of the invention, there is provided a spark plug which comprises: (a) a metal shell; (b) a center electrode retained in the metal shell to be insulated from the metal shell, the center electrode having a tip exposed outside the metal shell; (c) a ground electrode installed on the metal shell, the ground electrode having a tip which has a center electrode-opposed side surface facing the tip of the center electrode and an end surface; and (d) a noble metal member that is at least partially embedded in the end surface of the ground electrode and joined to the ground electrode by laser welding through a fused portion that forms a weld of the noble metal member and the ground electrode formed by materials of the ground electrode and the noble metal member melted together. The noble metal member has a tip projecting from the center electrode-opposed side surface of the ground electrode toward the center electrode so as to define a spark gap between the tip of the noble metal member and the tip of the center electrode.

In the preferred mode of the invention, if the width of a portion of the noble metal member closest to the fused portion in a direction perpendicular to the end surface of the ground electrode is defined as D1, the depth of a portion of the noble metal member embedded in the end surface of the ground electrode is greater than or equal to 0.5D1.

The noble metal chip has a length. A sectional area of the noble metal member traversing the length thereof is greater than or equal to 0.1 $mm^2$ and smaller than or equal to 0.6 $mm^2$.

If the width of the portion of the noble metal member in a direction parallel to the end surface of the ground electrode is defined as D2, the width of the fused portion is defined as N, and a maximum depth of the fused portion is defined as H, the maximum depth H is smaller than or equal to 2D1, and the width N is smaller than or equal to 2.5D2.

The depth of a portion of the noble metal member embedded in the end surface of the ground electrode is greater than or equal to 0.5D1.

The noble metal member may be made from one of a first material containing a main component of 50 Wt % or more of Pt and an additive of at least one of Rh, Ir, Os, Ni, W, Pd, and Ru and a second material containing a main component of 50 Wt % or more of Ir and an additive of at least one of Rh, Pt, Os, Ni, W, Pd, and Ru.

According to the third aspect of the invention, there is provided a method of fabricating a spark plug which comprises the step of: (a) preparing a center electrode; (b) placing a ground electrode so as to have a center electrode-opposed surface facing the center electrode through a spark gap; (c) preparing a noble metal member having a length and a first and a second end opposed to each other through the length; and (d) joining the noble metal member at the first end to the center electrode-opposed surface of the ground electrode by radiating a laser beam toward a corner defined by a side wall of the noble metal member continuing from the first end and the center electrode-opposed surface of the ground electrode from a direction diagonal to the center electrode-opposed surface to fuse a portion of the noble metal member and a portion the ground electrode, thereby forming a weld between the noble metal member and the ground electrode.

According to the fourth aspect of the invention, there is provided a method of fabricating a spark plug which comprises the step of: (a) preparing an assembly of a center electrode and a ground electrode, the center electrode being installed within a metal shell in an electric insulating fashion with a tip projecting from the metal shell, the ground electrode being installed on the metal shell with a tip having a center electrode-opposed side surface facing the tip of the center electrode and an end surface; (b) forming a groove in the end surface of the ground electrode; and (c) embedding a noble metal member at least partially embedded in the groove in the end surface of the ground electrode with a tip projecting from the center electrode-opposed side surface of the ground electrode toward the tip of the center electrode and joining the noble metal member to the ground electrode by laser welding to form a fused portion that is a weld of the noble metal member and the ground electrode made up of materials of the ground electrode and the noble metal member melted together.

BRIEF DESCRIPTION OF THE DRAWINGS

The present invention will be understood more fully from the detailed description given hereinbelow and from the accompanying drawings of the preferred embodiments of the invention, which, however, should not be taken to limit the invention to the specific embodiments but are for the purpose of explanation and understanding only.

In the drawings:

FIG. 3(*b*) is a plan view of FIG. 3(*a*);

FIG. 3(*c*) is a side view which shows the noble metal chip of FIG. 3(*a*) after welded to the ground electrode;

FIG. 3(*d*) is a plan view of FIG. 3(*c*);

FIG. 4(*b*) is a plan view of FIG. 4(*a*);

FIG. 5(*b*) is a sectional view taken along the line P—P in FIG. 5(*a*);

FIG. 11(*b*) is a plan view of FIG. 11(*a*);

FIG. 11(*c*) is a side view which shows the noble metal chip of FIG. 11(*a*) after welded to the ground electrode;

FIG. 11(*d*) is a plan view of FIG. 11(*c*);

FIG. 12(*b*) is a transverse sectional view which shows the joint of the noble metal chip and the ground electrode in FIG. 12(*a*);

FIG. 17(*b*) is a plan view of FIG. 17(*a*);

FIG. 17(*c*) is a side view which shows the noble metal chip of FIG. 17(*a*) after welded to the ground electrode;

FIG. 17(*d*) is a plan view of FIG. 17(*c*);

FIG. 18(*b*) is a plan view of FIG. 18(*a*);

FIG. 18(*c*) is a side view which shows the noble metal chip of FIG. 18(*a*) after welded to the ground electrode;

FIG. 18(*d*) is a plan view of FIG. 18(*c*);

FIG. 19(*b*) is a plan view of FIG. 19(*a*);

FIG. 19(*c*) is a side view which shows the noble metal chip of FIG. 19(*a*) after welded to the ground electrode;

FIG. 19(*d*) is a plan view of FIG. 19(*c*);

FIG. 20(*b*) is a plan view of FIG. 20(*a*);

FIG. 20(*c*) is a side view which shows the noble metal chip of FIG. 20(*a*) after welded to the ground electrode;

FIG. 20(*d*) is a plan view of FIG. 20(*c*);

FIG. 21(*b*) is a plan view of FIG. 21(*a*);

FIG. 21(*c*) is a side view which shows the noble metal chip of FIG. 21(*a*) after welded to the ground electrode;

FIG. 21(*d*) is a plan view of FIG. 21(*c*);

FIG. 22(*b*) is a plan view of FIG. 22(*a*);

FIG. 22(*c*) is a side view which shows the noble metal chip of FIG. 22(*a*) after welded to the ground electrode;

FIG. 22(*d*) is a plan view of FIG. 22(*c*);

FIG. 24(*b*) is a plan view of FIG. 24(*a*);

FIG. 24(*c*) is a side view which shows the noble metal chip of FIG. 24(*a*) after welded to the ground electrode;

FIG. 24(*d*) is a transverse sectional view of FIG. 24(*c*);

FIG. 25(*b*) is a plan view of FIG. 25(*a*);

FIG. 25(*c*) is a side view which shows the noble metal chip of FIG. 25(*a*) after welded to the ground electrode;

FIG. 25(*d*) is a transverse sectional view of FIG. 25(*c*);

FIG. 26(*b*) is a side view which shows a joint between the noble metal chip and the ground electrode, as shown in FIG. 26(*a*), after laser-welding;

FIG. 26(*c*) is a side view which shows the second modified form of a tip of a ground electrode to which a noble metal chip is welded in the second embodiment of the invention;

FIG. 26(*d*) is a side view which shows a joint between the noble metal chip and the ground electrode, as shown in FIG. 26(*c*), after laser-welding;

FIGS. 27(*e*), 27(*f*), 27(*g*), and 27(*h*) show modified forms of a tip of a ground electrode in the second embodiment of the invention in order to decrease thermal stress added to a joint between a noble metal chip and the ground electrode;

FIG. 28(*b*) is a partially sectional view which shows a modification of an internal structure of a ground electrode in the first embodiment of the invention;

FIG. 29(*b*) is a partial side view which shows a modification of a ground electrode in the first embodiment of the invention in which the degree of bending of the ground electrode is smaller.

DESCRIPTION OF THE PREFERRED EMBODIMENTS

Figure 1:
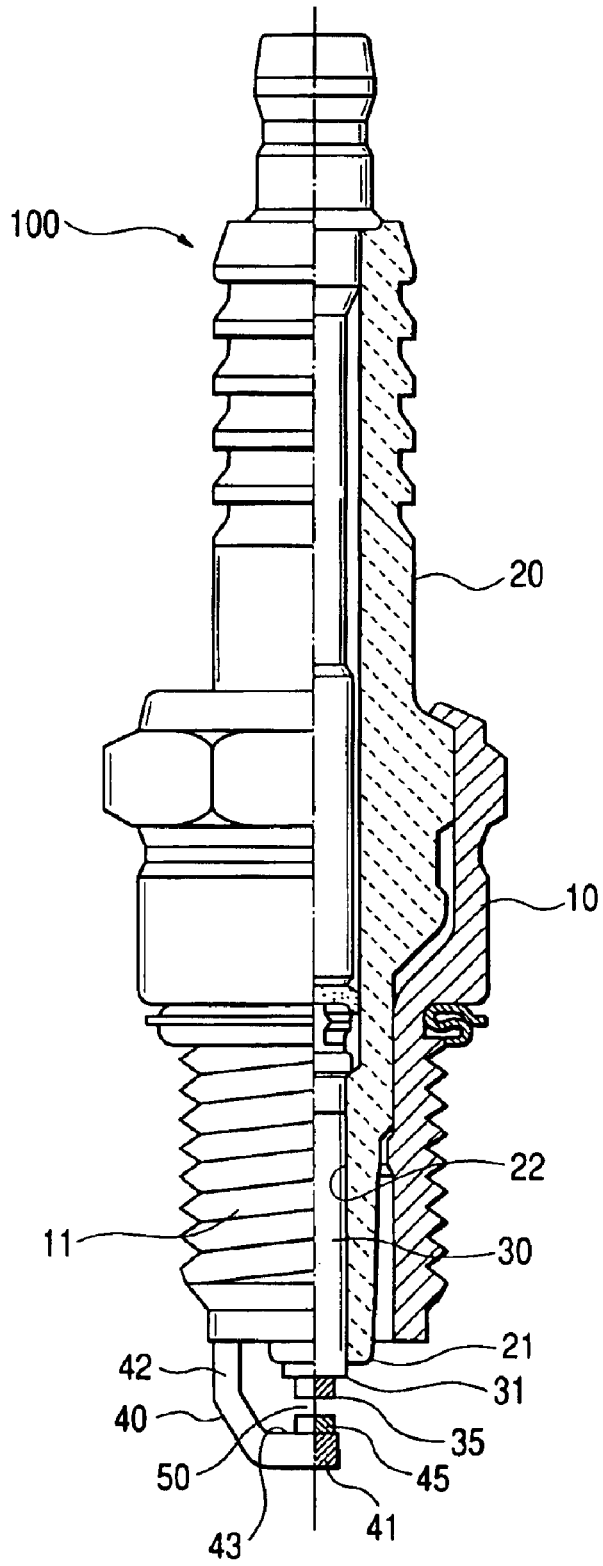
FIG. 1 is a partially sectional view which shows a spark plug according to the first embodiment of the invention.

Referring to the drawings, wherein like reference numbers refer to like parts in several views, particularly to FIG. 1, there is shown a spark plug 100 which may be used in internal combustion engines for automotive vehicles.

The spark plug 100 includes a cylindrical metal shell (housing) 10, a porcelain insulator 20, a center electrode 30, and a ground electrode 40. The metal shell 10 is made of a conductive iron steel such as a low carbon steel and has cut therein a thread 11 for mounting the spark plug 100 in an engine block (not shown). The porcelain insulator 20 made of an alumina ceramic ($Al_2O_3$) is retained within the metal shell 10 and has a tip 21 exposed inside the metal shell 10.

The center electrode 30 is secured in a central chamber 22 of the porcelain insulator 20 and insulated electrically from the metal shell 10. The center electrode 30 has a tip 31 projecting from the tip 21 of the porcelain insulator 20. The center electrode 30 is formed by a cylindrical member which is made up of a core portion made of a metallic material such as Cu having a higher thermal conductivity and an external portion made of a metallic material such as an Ni-based alloy having higher thermal and corrosion resistances.

The ground electrode 40 is formed by a prismatic pole made of an Ni alloy whose main component is nickel and welded at a base 42 thereof directly to an end of the metal shell 10. The ground electrode 40 is, as clearly shown in FIG. 2, bent to an L-shape to have a tip 41 which faces at an inner side surface 43 thereof the tip 31 of the center electrode 30 through a spark gap 50. Noble metal chips 35 and 45 are, as described later in detail, joined by laser welding to an end surface of the tip 31 of the center electrode 30 and the inner side surface 43 of the ground electrode 40, respectively. The laser welding results in formation of fused portions 34 and 44. The fused portions 34 are each formed by materials of the center electrode 30 and the noble metal chip 35 melted together. Similarly, the fused portions 44 are each formed by materials of the ground electrode 40 and the noble metal chip 45 melted together.

Each of the noble metal chips 35 and 45 is formed by a cylindrical member and laser-welded at an end thereof to one of the center and ground electrodes 30 and 40. The spark gap 50 is defined by an interval between the chips 35 and 45 which is, for example, 1 mm.

Each of the chips 35 and 45 is made of a noble metal such as Pt, Pt alloy, Ir, or Ir alloy. For example, a material containing a main component of 50 Wt % of Ir or more and an additive of at least one of Rh (rhodium), Pt (platinum), Ru (ruthenium), Pd (palladium), and W (tungsten) (referred to as an Ir-10Rh below) may be used. In this embodiment, each of the chips 35 and 45 is made of an Ir alloy containing 90 Wt % of Ir and 10 Wt % of Rh.

The spark plug 100 may be fabricated in a known manner, but the joining of the noble metal chip 45 to the tip 43 of the ground electrode 40 is achieved in this embodiment by a unique laser welding method, as discussed below, with reference to FIGS. 3(*a*) to 4(*b*). Arrows LZ, as illustrated in FIGS. 3(*a*), 3(*b*), 4(*a*), 4(*b*), are directions of radiation of laser beams.

First, the cylindrical noble metal chip 45 is, as shown in FIGS. 3(*a*) and 4(*a*), placed at an end thereof on the inner side surface 43 of the ground electrode 40. Subsequently, laser beams are, as shown in FIGS. 3(*a*), 3(*b*), 4(*a*), and 4(*b*), radiated around a corner 45*b* defined by a side surface 45*a* of the noble metal chip 45 and the inner side surface 43 of the tip 41 of the ground electrode 40 from a direction oblique to the side surface 45*a* and the inner side surface 43 to fuse contact portions of the noble metal chip 45 and the tip 41 of the ground electrode 40. This, as shown in FIGS. 3(*c*) and 3(*d*), results in formation of the fused portions 45 made up of the materials of the chip 45 and the ground electrode 40 melted together. The fused portions 45 partially overlap each other around the chip 45.

Figure 4A:
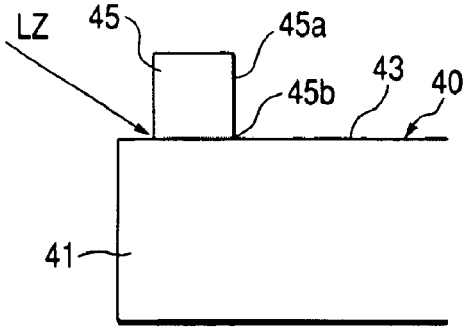
FIG. 4(*a*) is a side view which shows a modified form of a welding method of laser-welding a noble metal chip to a ground electrode.
Figure 4B:
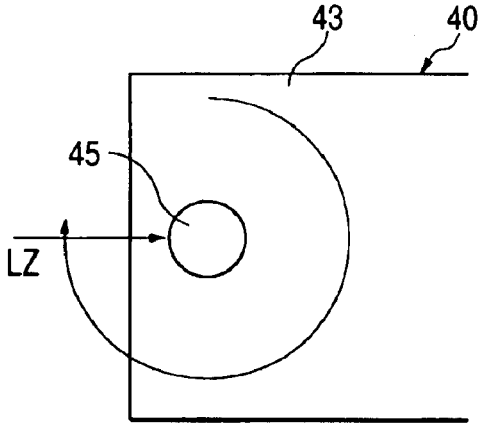

The laser welding, as illustrated in FIGS. 3(*a*) and 3(*b*), is accomplished by radiating six laser beams simultaneously to the corner 45*b* at fixed angular intervals (i.e., 60°) without moving them, while the laser welding, as illustrated in FIGS. 4(*a*) and 4(*b*), is accomplished by radiating a laser beam to the corner 45*b* six times at an angular interval of 60° while turning the chip 45 and the ground electrode 40 together about a longitudinal center line of the chip 45. The number of laser spots may be determined as a function of the size or shape of the chip 45.

Figure 2:
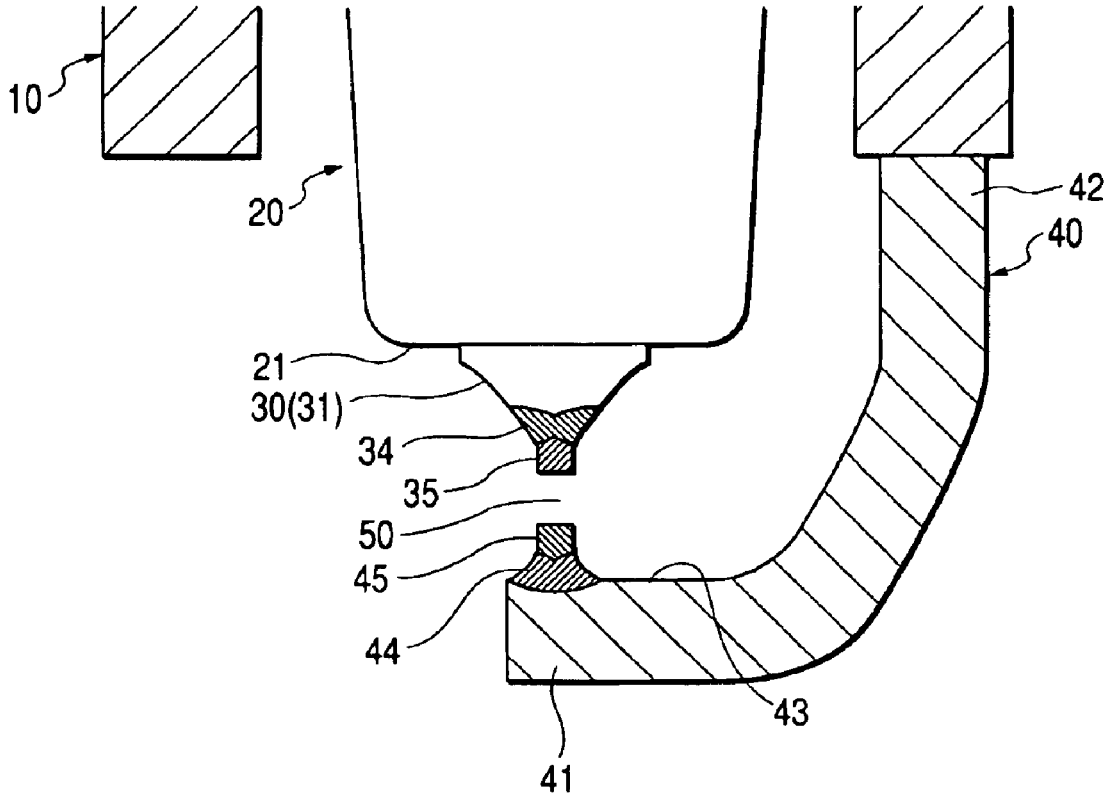
FIG. 2 is an enlarged view which shows tips of a ground and a center electrode of the spark plug of FIG. 1.
Figure 3A:
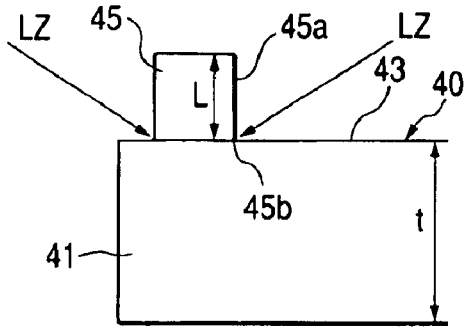
FIG. 3(*a*) is a side view which shows a noble metal chip to be welded to a ground electrode.
Figure 3C:
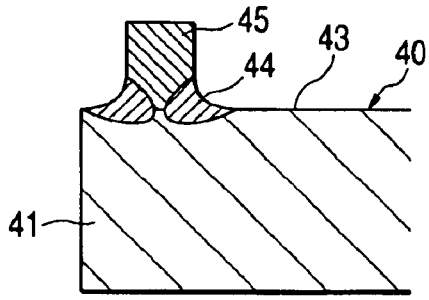
Figure 3B:
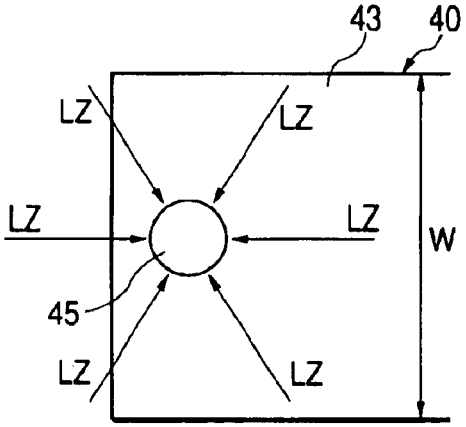
Figure 3D:
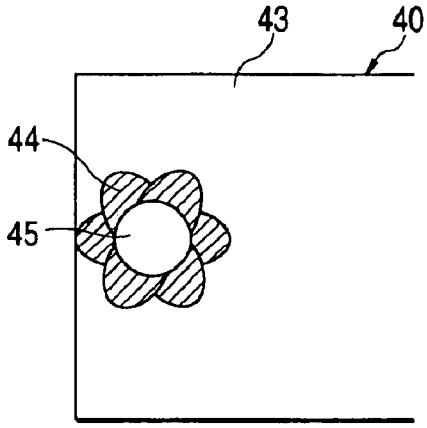
Figure 5A:
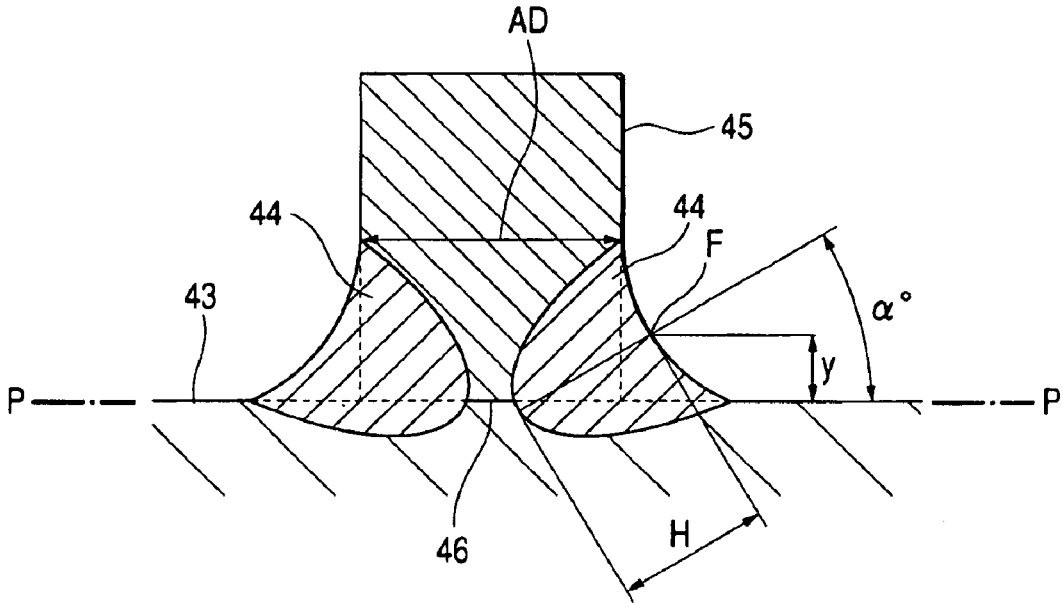
FIG. 5(*a*) is an enlarged view which shows a structure of a joint of a noble metal chip and a ground electrode.
Figure 5B:
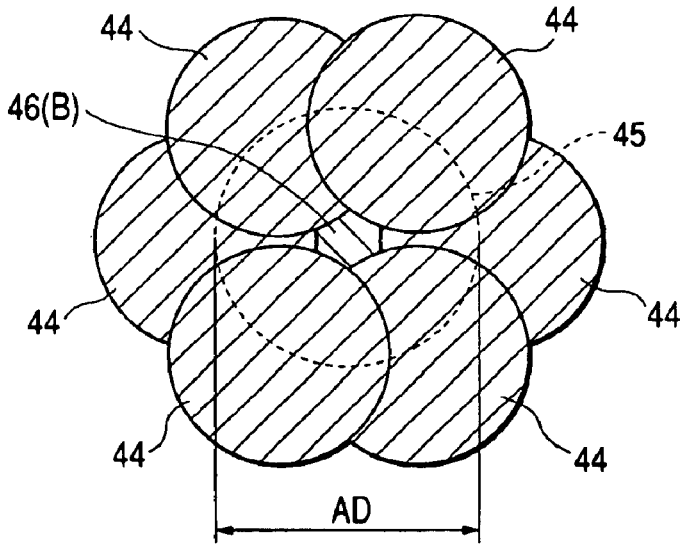

FIG. 5(*a*) is an enlarged view of FIGS. 2 and 3(*c*) which shows the fused portions 45 formed around the noble metal chip 45. FIG. 5(*b*) is a sectional view taken along the line P—P in FIG. 5(*a*) which shows a boundary surface between the end of the chip 45 and the inner side surface 43 of the ground electrode 40. Broken lines in FIG. 5(*a*) indicate contours of the chip 45 and the inner side surface 43 before the welding.

The noble metal chip 45 has a given length and a lateral sectional area (i.e., a circular traverse area in this embodiment) of 0.1 $mm^2$ to 0.6 $mm^2$. In the following discussion, a sectional area of a portion of the noble metal chip 45 closest to the fused portions 44 is, as shown in FIG. 5(*a*), defined as A (will be referred to as a fused portion closest sectional area below). On the boundary surface of the noble metal chip 45 (i.e., the P—P sectional area), an unfused portion 46 exists which is a portion of the noble metal chip 45 remaining unfused with the inner side surface 43 of the ground electrode 40.

In this embodiment, the percentage C (will be referred to as an unfused sectional area percentage below) of a sectional area B of the unfused portion 46 within a range, as indicated by a broken line in FIG. 5(*b*), of the fused portion closest sectional area A of the noble metal chip 45 is 50% or less (i.e., $C=100B/A\ \% \leqq 50\%$). The angle $\alpha$ (will be referred to as a melt angle below) which a line, as shown in FIG. 5(*a*), extending along the maximum melt depth H of each of the fused portions 44 makes with the inner side surface 43 of the tip 41 of the ground electrode 40 is 60° or less ($\alpha \leqq 60°$). If a point at which the line extending in the direction of the maximum melt depth H of each of the fused portions 44 intersects an outer surface of the fused portion 44 is, as shown in FIG. 5(*a*), defined as F which will be referred to as a central melt point below, and the distance between the central melt point F and the inner side surface 43 of the ground electrode 40 is defined as y (will be referred to as a central melt point distance below), the location of the central melt point F is preferably between −0.2 mm and 0.3 mm (i.e., $-0.2\ mm \leqq y \leqq 0.3\ mm$), as expressed as a function of the central melt point distance y, where when the central melt point F is located, as viewed in FIG. 5(*a*), above and below the inner side surface 43, the location thereof is expressed in a positive value (+) and a negative value (−), respectively, and when the central melt point F lies on the inner side surface 43, the location thereof is defined as 0 mm. The melt angle α lies preferably within a range of (30+100y)° or less in a relation to the central melt point distance y between the central melt point F and the inner side surface 43 of the ground electrode 40. Further, if the width (i.e., the diameter in this embodiment) of the sectional area A is defined as D, the maximum melt depth H of each of the fused portions 44 is preferably less than or equal to 1.4 times the width D (H≦1.4D).

The above described dimensional requirements are provided in order to decrease thermal stress occurring at the weld of the noble metal chip 45 and the ground electrode 40 and established based on the following researches.

We performed durability tests on spark plug samples installed in a 6-cylinder 2000 cc engine. The engine was idled for one minute and then run at a full speed of 6000 rpm. for one minute. This cycle was repeated for 100 hours. After the durability tests, we evaluated the durability of the spark plug samples in a manner, as discussed below, in terms of a percentage of a separated portion of a boundary surface between the noble metal chip 45 and each of the fused portions 44 (will also be referred to as a chip-fused portion separation percentage below) and a percentage of a separated portion of a boundary surface between each of the fused portions and the ground electrodes 40 (will also be referred to as a fused portion-electrode separation percentage below).

Figure 6:
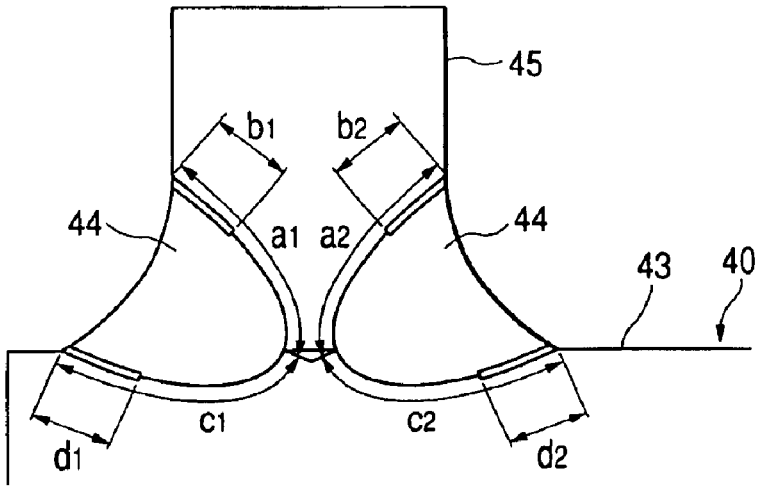
FIG. 6 is an enlarged view which shows dimensions of laser-fused portions formed between a noble metal chip and a ground electrode.

The chip-fused portion separation percentage is expressed by {(b1+b2)/(a1+a2)}×100 (%). The fused portion-electrode separation percentage is expressed by {(d1+d2)/(c1+c2)}×100 (%). a1 and a2 indicate, as shown in FIG. 6, lengths of the boundary surfaces between the fused portions 44 and the noble metal chip 45. c1 and c2 indicate lengths of the boundary surfaces between the fused portions 44 and the inner side surface 43 of the ground electrode 40. b1, b2, d1, and d2 indicate lengths of the separated portions of the boundary surfaces, respectively. The lengths and shapes of the separated portions may be observed using a metallographic microscope. The greater of the chip-fused portion separation percentage and the fused portion-electrode separation percentage was selected as a separation percentage to evaluate the durability or joint strength of the weld between the noble metal chip 45 and the ground electrode 40 of each spark plug sample.

Figure 7:
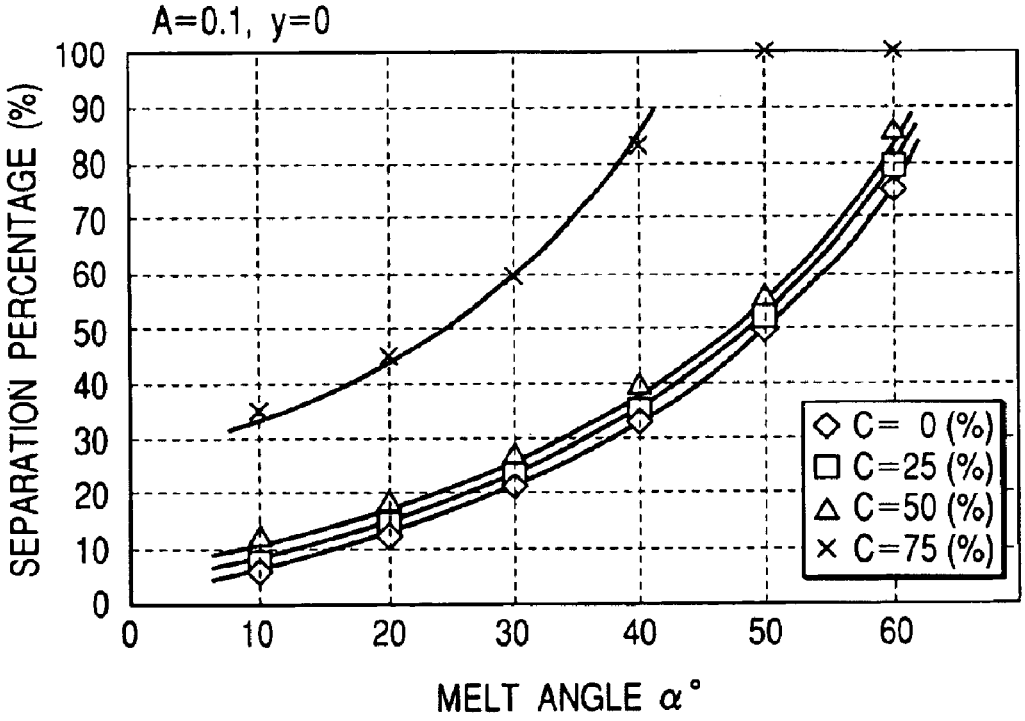
FIG. 7 is a graph which represents a relation between a separation percentage of a portion of a boundary area between a noble metal chip and a ground electrode which is separated after durability tests and a melt angle $\alpha$, as shown in FIG. 5(*a*), for different values of a unfused sectional area percentage of the boundary area.

FIG. 7 represents the effects of the unfused sectional area percentage C and the melt angle α on the mechanical strength of the weld between the noble metal chip 45 and the ground electrode 40. The noble metal chip 45 used in each of the spark plug samples is made of an Ir-10Rh cylindrical member which has a diameter D of 0.36 mm (the fused portion closest sectional area A=0.1 $mm^2$) and a length L, as shown in FIG. 3(*a*), of 0.8 mm. The ground electrode 40 is made of a Ni-based alloy such as Inconel (trade mark) and has a width W of 2.8 mm and a thickness t of 1.6 mm. The central melt point distance y, as shown in FIG. 5(*a*), between the central melt point F and the inner side surface 43 of the ground electrode 40 is zero (0).

The graph of FIG. 7 represents a relation between the separation percentage (%) and the melt angle α (°) when the unfused sectional area percentage C is 0%, 25%, 50%, and 75%. We used the six spark plug samples for each unfused sectional area percentage C and each melt angle α and plotted one of them showing the greatest separation percentage in the graph of FIG. 7. The graph shows that the smaller the unfused sectional area percentage C and the melt angle α, the lower the separation percentage. We used the spark plug samples having the melt angles α changed by 10° and encountered a problem in that the noble metal chip 45 was scraped out undesirably by radiation of laser beams 40 in a case where the melt angle α was greater than 60°, thereby resulting in a greatly decreased joint strength between the metal chip 45 and the ground electrode 40.

The graph shows that the joint strength is increased as the melt angle α is decreased. This is because the decreasing of the melt angle α allows a fused portion of the noble metal chip 45 to be increased, thereby increasing an Ir alloy content of the fused portions 44 (i.e., resulting in a decrease in difference in linear expansion coefficient between the chip 45 and the fused portions 44), which results in a decrease in thermal stress acting on the boundary surfaces between the chip 45 and the fused portions 44.

The graph also shows that when the unfused sectional area percentage C is less than 50%, the spark plug samples have substantially the same joint strength, but when it reaches 75%, the joint strength is decreased greatly. This is because the sectional area B of the unfused portion 46 is too great, while the fused portions 44 are too small in size to have the fused portions 44 serve as thermal stress absorbers.

Although not illustrated, we confirmed that the effects of the unfused sectional area percentage C and the melt angle α on the joint strength between the noble metal chip 45 and the ground electrode 40 are the same as that shown in FIG. 7 regardless of a transverse sectional area of the noble metal chip 45 which is equal to the fused portion closest sectional area A of the noble metal chip 45 in this embodiment.

Figure 8:
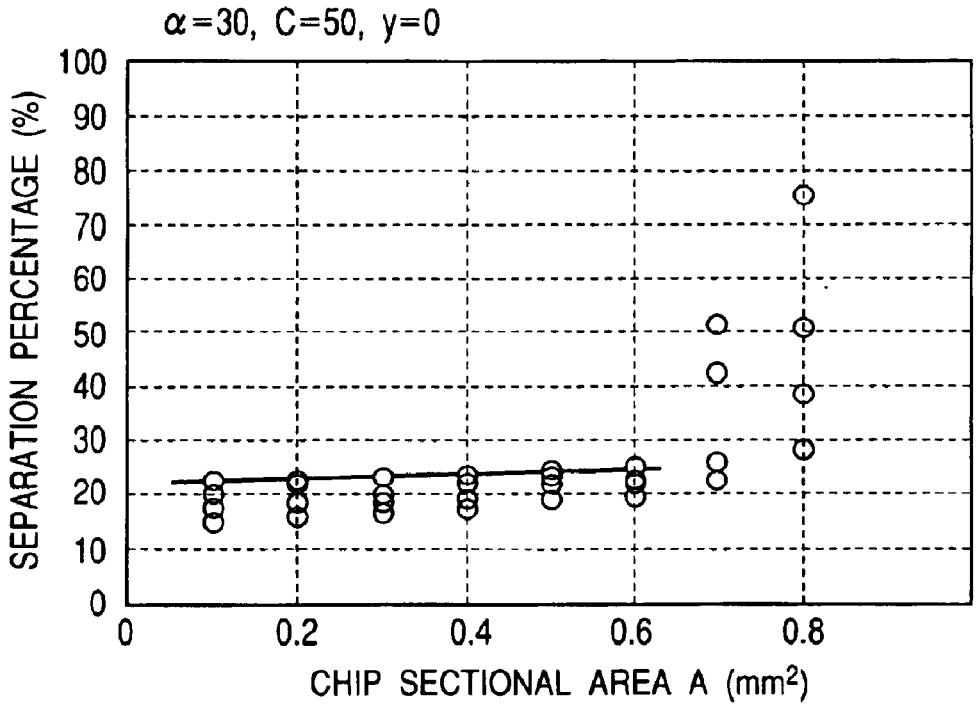
FIG. 8 is a graph which represents a relation a separation percentage of a boundary area between a noble metal chip and a ground electrode and a sectional area of the noble metal chip closest to fused portions.

We also researched, as shown in FIG. 8, the effects of the sectional area A of a portion of the noble metal chip 45 closest to the fused portions on the joint strength between the noble metal chip 45 and the ground electrode 40 using spark plug samples which include the noble metal chip 45 made of an Ir-10Rh cylindrical member whose length L is 0.8 mm and the ground electrode 40 identical with that of the spark plug samples of FIG. 7. In each spark plug sample, the melt angle α is 30°. The unfused sectional area percentage C is 50%. The central melt point distance y between the central melt point F and the inner side surface 43 of the ground electrode 40 is zero (0). We prepared the four spark plug samples for each sectional area A.

FIG. 8 represents a relation the separation percentage (%) and the fused portion closest sectional area A ($mm^2$) of the noble metal chip 45. The graph of FIG. 8 shows that the separation percentage is low when the closest sectional area A lies within a range of 0.1 $mm^2$ to 0.6 $mm^2$, which provides a higher joint strength between the noble metal chip 45 and the ground electrode 40, but when the closest sectional area A exceeds 0.6 $mm^2$, the joint strength decreases greatly. This is because the greater the closest sectional area A, the greater will be a thermal capacity of the noble metal chip 45, thus resulting in an increase in thermal stress added to the boundary surface between the chip 45 and the fused portions 44. We also confirmed that when the fused portion closest sectional area A of the noble metal chip 45 is smaller than 0.1 $mm^2$, the noble metal chip 45 is too thin to withstand sparks produced between the center electrode 30 and the ground electrode 40.

It is, thus, found that the use of the noble metal chip 45 whose fused portion closest sectional area A lies within a range of 0.1 $mm^2$ to 0.6 $mm^2$ (0.1 $mm^2 \leqq A \leqq 0.6$ $mm^2$) provides a higher ignitability of a gaseous fuel.

The noble metal chip 45 used in this embodiment is made of a cylindrical member having the diameter uniform over a length thereof, but however, may alternatively be formed by a cylinder with a shoulder. For instance, a base portion of the noble metal chip 45 close to the fused portions 44 may be thinner or thicker than the top thereof close to the center electrode 30.

Further, we also researched optimum values of the central melt point distance y and the melt depth H in a manner, as discussed below, in order to improve the reliability of the joint between the noble metal chip 45 and the ground electrode 40. We evaluated the joint reliability by measuring, like the above, the separation percentage after durability tests using spark plug samples installed in the engine and determined that when the separation percentage is less than or equal to 25%, the joint reliability is sufficient for ensuring desired performance of the spark plug 100.

Figure 9:
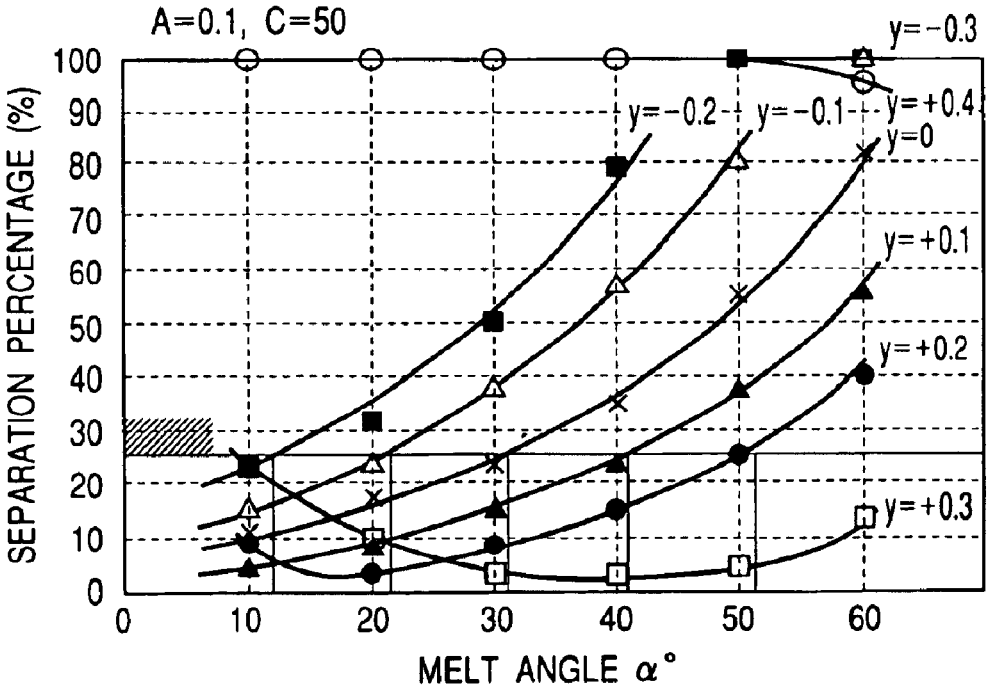
FIG. 9 is a graph which shows a relation between a separation percentage of a boundary area between a noble metal chip and a ground electrode and a melt angle $\alpha$, as shown in FIG. 5(*a*), for different values of distance between a central point of fused portions and a surface of the ground electrode.

First, we performed the durability tests on the spark plug samples and confirmed, as shown in FIG. 9, the effects of the central melt point distance y on the joint reliability. In each spark plug sample, the noble metal chip 45 and the ground electrode 40 are identical with those used in the durability tests as shown in FIG. 7. The unfused sectional area percentage C is 50%.

FIG. 9 shows a relation between the melt angle α(°) and the separation percentage (%) for the central melt point distance y=−0.3 mm to 0.4 mm. We used the six spark plug samples for each melt angle α and each central melt point distance y and plotted one of them showing the greatest separation percentage in the graph of FIG. 9. The graph shows that when the central melt point distance y is smaller than −0.2 mm or greater than 0.3 mm, the separation percentage will be almost 100% regardless of the melt angle α, but however, when the central melt point distance y is between −0.2 mm and 0.3 mm (−0.2 mm≦y≦0.3 mm), and the melt angle α is less than or equal to (30+100y)°, the separation percentage will be less than or equal to 25%, thus ensuring a higher degree of reliability of the joint between the noble metal chip 45 and the ground electrode 40 even after the durability tests. This is because when the central melt point distance y is smaller than −0.2 mm, an Ir-alloy content of the fused portions 44 will be decreased, so that a difference in linear expansion coefficient between the chip 45 and the fused portions 44 increases greatly, thus resulting in an increase in thermal stress occurring at the boundary surface between the chip 45 and the fused portions 44, and when the central melt point distance y is greater than 0.3 mm, the Ir-alloy content of the fused portions 44 will be increased greatly, so that the difference in linear expansion coefficient between the chip 45 and the fused portions 44, like the above, increases greatly, thus resulting in an increase in thermal stress occurring at the boundary surface between the chip 45 and the fused portions 44.

Although not illustrated, we confirmed that the same effects of the melt angle α and the central melt point distance y on the joint strength between the noble metal chip 45 and the ground electrode 40 as described above are obtained regardless of a transverse sectional area of the noble metal chip 45 which is equal to the fused portion closest sectional area A of the noble metal chip 45 in this embodiment.

Figure 10:
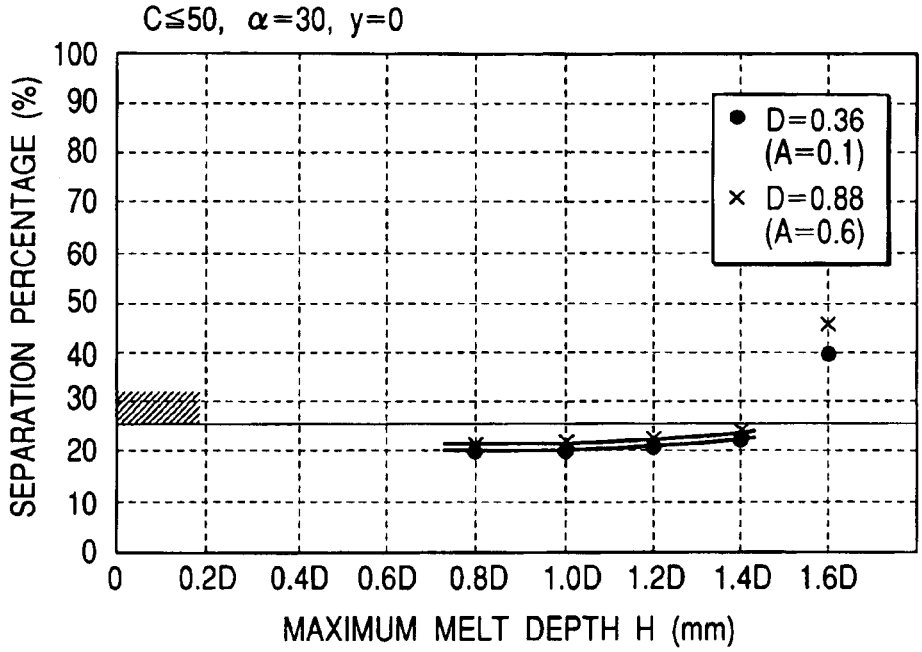
FIG. 10 is a graph which shows a relation between a separation percentage of a boundary area between a noble metal chip and a ground electrode and a melt depth H, as shown in FIG. 5(*a*), for different values of width of the noble metal chip.
Figure 11A:
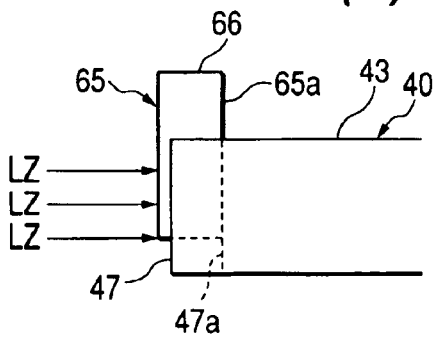
FIG. 11(*a*) is a side view which shows a noble metal chip to be welded to a ground electrode in the second embodiment of the invention.
Figure 11C:
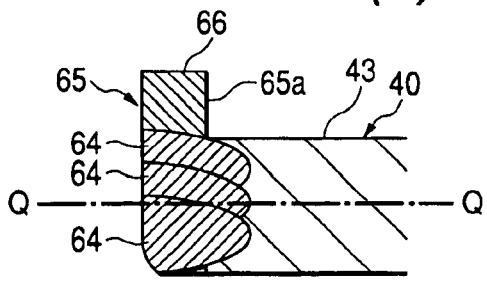
Figure 11B:
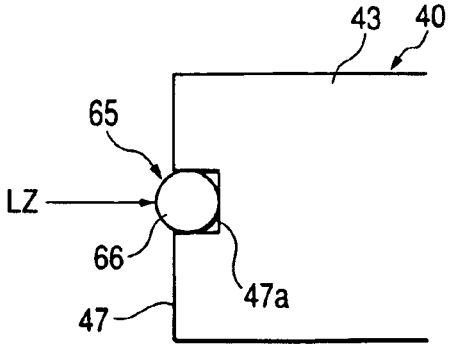
Figure 11D:
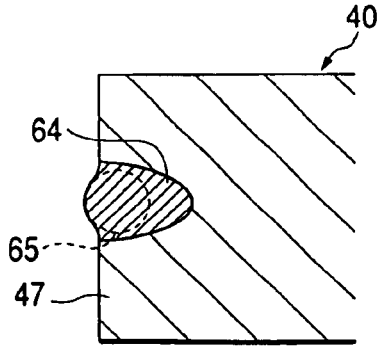

Next, we performed the durability tests and researched, as shown in FIG. 10, the effects of the melt depth H on the reliability of the joint between the noble metal chip 45 and the ground electrode 40. The noble metal chip 45 of each spark plug sample used in the durability tests is made of an Ir-10Rh cylindrical member which has a diameter D of 0.36 mm (the fused portion closest sectional area A=0.1 $mm^2$) and a length L of 0.8 mm. The ground electrode 40 is the same as that used in the durability tests of FIG. 7. The melt angle α is 30°. The central melt point distance y is zero (0). The unfused sectional area percentage C is less than or equal to 50%.

FIG. 10 shows a relation between the melt depth H (mm) and the separation percentage (%) for the fused portion closest sectional area A of the noble metal chip 45=0.1 $mm^2$ (i.e., the width D=0.36 mm) and 0.6 $mm^2$ (i.e., the width D=0.88 mm). We used the six spark plug samples for each melt angle α, each melt depth H, and each fused portion closest sectional area A and plotted one of them showing the greatest separation percentage in the graph of FIG. 10. The graph shows that when the fused portion closest sectional area A lies within a range of 0.1 $mm^2$ to 0.6 $mm^2$, the separation percentage will be 25% or less as long as the melt depth H is less than 1.4 times the width D of the noble metal chip 45, thus ensuring a higher degree of reliability of the joint between the noble metal chip 45 and the ground electrode 40 after the durability tests, but however, when the melt depth H exceeds 1.4D, the separation percentage will be great, thus resulting in a great reduce in joint reliability. This is because when the melt depth H of the fused portions 44 is greater than 1.4D, a large quantity of the material of the ground electrode 40 is melt in the fused portions 44, thus resulting in an increase in Ir alloy content of the fused portions 44, which causes the thermal stress created on the boundary surface between the chip 45 and the fused portions 44 to increase.

The above described structure of the spark plug 100 also eliminates the need for pressing and embedding, like Japanese Patent First Publication No. 9-106880 as discussed in the introductory part of this application, the noble metal chip 45 in the ground electrode 40 for achieving a firm joint thereof, which permits the noble metal chip 45 to be joined to the inner side surface 43 of the ground electrode 40 only by radiating laser beams to a boundary between the noble metal chip 45 and the inner side surface 43 from a diagonal direction, thus avoiding the collapse of the chip 45 caused by the pressing.

The second embodiment of the invention will be described below with reference to FIGS. 11(*a*) to (*d*).

The spark plug 100 of the second embodiment has a noble metal chip 66 jointed to an end surface of the ground electrode 40.

The ground electrode 40, like the first embodiment, faces the center electrode 30 at the inner side surface 43 thereof. The ground electrode 40 has, as clearly shown in FIGS. 11(*a*) and 11(*b*), a groove 47*a* formed in an end surface 47 thereof. The groove 47*a* extends in a thickness-wise direction of the ground electrode 40 toward the center electrode 30. The noble metal chip 45 is made of a cylindrical member and fitted at a peripheral side surface 65*a* thereof within the groove 47*a* at least partially. The noble metal chip 45 is, as clearly shown in FIGS. 11(*c*) and 11(*d*), welded to the end surface 47 of the ground electrode 40 and has a tip portion 66 opposed to the center electrode 30 through the spark gap. The noble metal chip 65 may be made from the same material as that of either of the noble metal chips 35 and 45 in the first embodiment and may alternatively be formed by a prismatic rod or block.

The joining of the noble metal chip 65 to the ground electrode 40 is achieved in the following steps.

First, the groove 47*a* is, as shown in FIGS. 11(*a*) and 11(*b*), formed in the end surface 47 of the ground electrode 40 by milling, punching, or pressing. The peripheral side surface 65*a* of the noble metal chip 65 is fitted partially within the groove 47*a* with the tip portion 66 projecting from the inner side surface 43 of the ground electrode 40 toward the center electrode 30.

Next, laser beams are, as indicated by arrows LZ in FIGS. 11(*a*) and 11(*b*), radiated to the peripheral side surface 65*a* of the noble metal chip 65 to weld the noble metal chip 65 to the end surface 47 of the ground electrode 40. This results in formation of fused portions 64, as shown in FIGS. 11(*c*) and 11(*d*). The number of laser beams and portions of the noble metal chip 65 to which the laser beams are radiated may be changed depending upon the size and shape of the noble metal chip 65.

The welding of the noble metal ship 65 to the ground electrode 40 is, as described above, accomplished by fitting the portion of the noble metal chip 65 in the groove 47*a* and radiating laser beams thereto, thus preventing the noble metal chip 65 from being scraped out undesirably by radiation of the laser beams as compared with the structure as taught in Japanese Patent First Publication No. 11-354251 discussed in the introductory part of this application. This permits the noble metal chip 65 to be thinned without decreasing the fused portions 44 undesirably and also results in an increase in quantity of heat transmitted from the noble metal chip 65 to the ground electrode 40.

The fused portions 64 are formed at a distance from the spark gap, thus resulting in a decrease in number of sparks reaching the fused portions 64, which avoids the undesirable dislodgement of the noble metal chip 65 from the ground electrode 40.

Figure 12A:
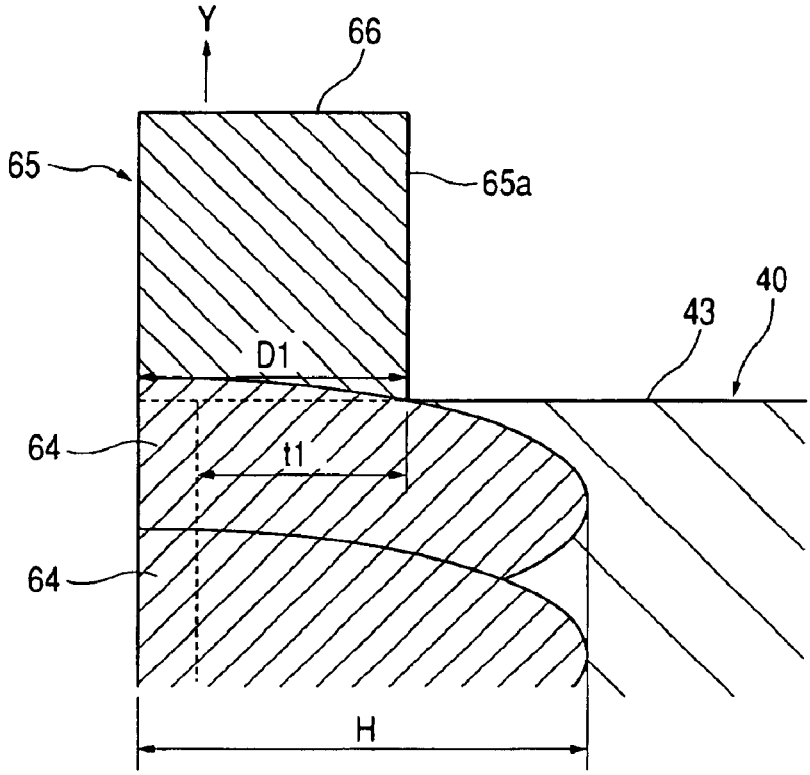
FIG. 12(*a*) is an enlarged view which shows a joint of a noble metal chip and a ground electrode.
Figure 12B:
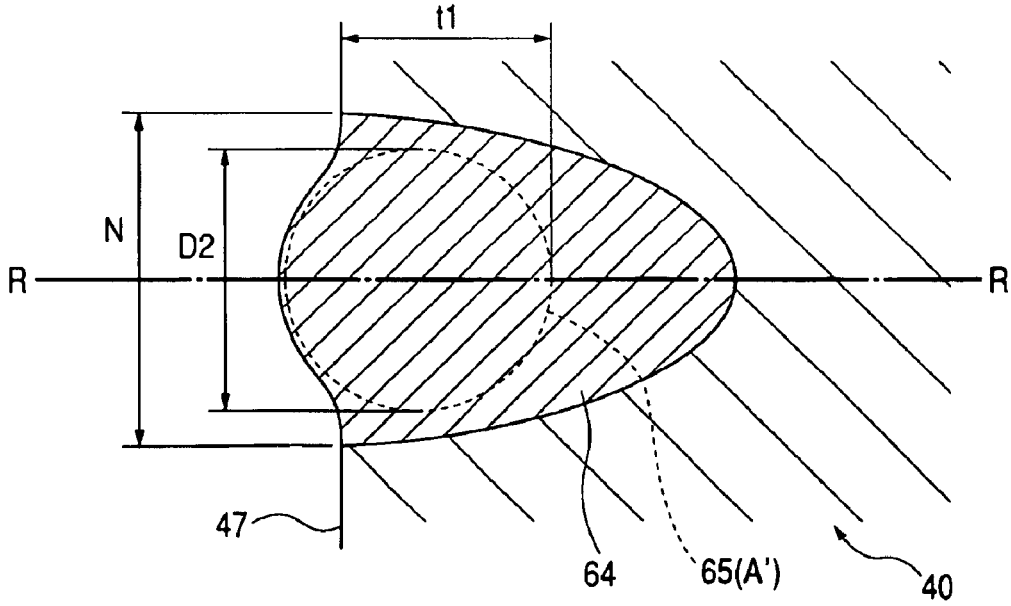

FIG. 12(*a*) is an enlarged view which illustrates the joint of the noble metal chip 65 and the ground electrode 40.

If the width of a portion of the noble metal chip 65 closest to the fused portions 64 in a direction perpendicular to the end surface 47 of the ground electrode 40 (i.e., the diameter of the noble metal chip 65 in this embodiment) is defined as D1, the depth t1 of the noble metal chip 65 embedded in the groove 47*a* of the ground electrode 40 is preferably greater than 0.5 times the width D1 (t1≧0.5D1).

Additionally, a sectional area A' of the noble metal chip 65 extending perpendicular to the length thereof is preferably between 0.1 $mm^2$ and 0.6 $mm^2$ (0.1 $mm^2 \leqq A' \leqq 0.6\ mm^2$). The sectional area A' is, as clearly shown in FIG. 12(*b*), circular and will be referred to as a chip sectional area A' below.

If a maximum width of each of the fused portions 64 is defined as N(will be referred to as a melt width below), and the width of the portion of the noble metal chip 64 closest to the fused portions 65 in a direction parallel to the end surface 47 of the ground electrode 40 (i.e., the diameter of the noble metal chip 65 in this embodiment) is defined as D2, a maximum depth of each of fused portion 65 is defined as H is preferably less than or equal to twice the width D1. The melt width N is preferably less than or equal to 2.5 times the width D2.

The above described dimensional requirements are provided in order to ensure a desired mechanical strength of the joint between the noble metal chip 65 and the ground electrode 40 and established based on the following researches.

We performed durability tests on spark plug samples installed in the engine and researched a relation between the embedded depth t1 of the noble metal chip 65 and the mechanical strength of the joint between the noble metal chip 65 and the ground electrode 40 after laser-welding. The noble metal chip 65 of each spark plug sample is made of an Ir-10Rh cylindrical member which has a diameter of 0.36 mm (=D1=D2, the chip sectional area A'=0.1 $mm^2$) and a length L of 0.8 mm. The ground electrode 40 is made from Inconel and has a width of 2.8 mm and a thickness of 1.6 mm. The melt depth H is 2D1. The melt width N is 2.5D2.

We measured, as the joint strength, the tensile strength of the noble metal chip 65 of each spark plug sample subjected to a stretching load, as indicated by an arrow Y in FIG. 12(*a*), toward the center electrode 30. The measurements are shown in FIG. 13.

Figure 13:
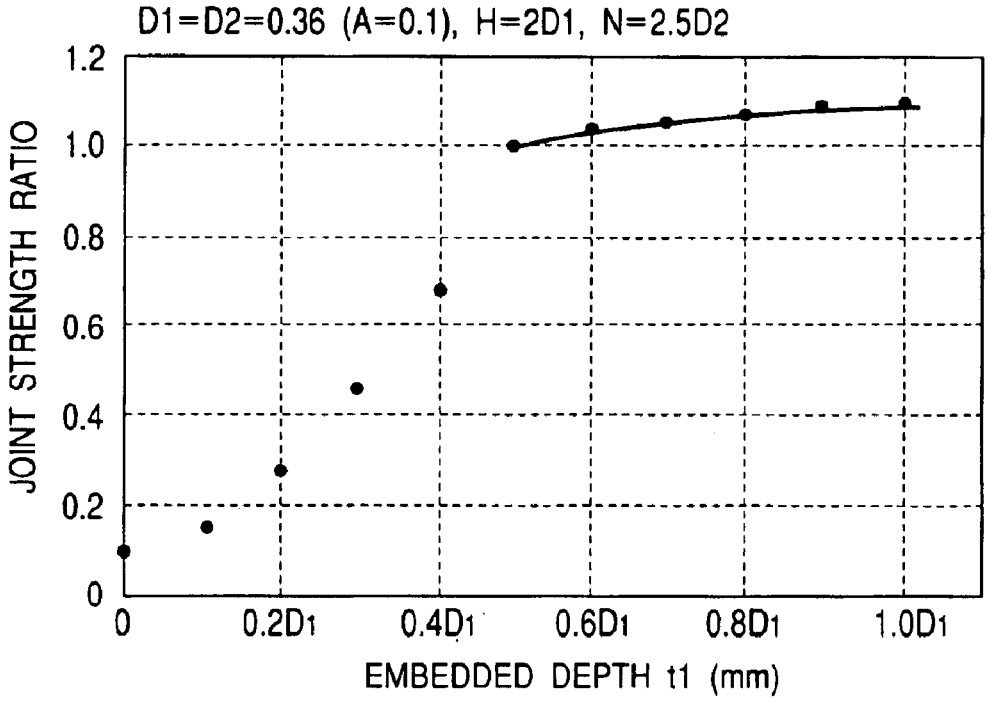
FIG. 13 is a graph which shows a relation between a mechanical strength of a joint between a noble metal chip and a ground electrode and a depth of a portion of the noble metal chip embedded in a groove formed in the ground electrode.

FIG. 13 shows a relation between the embedded depth t1 (mm) of the noble metal chip 65 and the joint strength between the noble metal chip 65 and the ground electrode 40 of the spark plug samples after laser-welding. The embedded depth t1 is expressed by a multiple of the width D1 of the noble metal chip 65. The tensile strength of the noble metal chip 65 when the embedded depth t1 is 0.5D1 is defined as one (1). The joint strength of each spark plug sample is expressed by a multiple of such a reference value. We used the six spark plug samples for each embedded depth t1 and plotted one of them showing the greatest joint strength. The graph of FIG. 13 shows that the when the embedded depth t1 of the noble metal chip 65 is greater than or equal to 0.5D1, the spark plug samples have substantially the same higher joint strength, but when the embedded depth t1 is decreased below 0.5D1, it results in a great reduction in joint strength. This is because as the embedded depth t1 decreases, a portion of the noble metal chip 65 exposed outside the end surface 47 of the ground electrode 40 increases, so that the noble metal chip 65 is heated by laser beams, while most of the end surface 47 is hardly heated, which may cause the noble metal chip 65 to be scraped out greatly by the leaser beams. A problem was also encountered in that a heated spot was formed on the noble metal chip 65 during the durability tests, thus resulting in an increase in wear thereof.

Although not illustrated, we confirmed that the effects of the embedded depth t1 on the joint strength between the noble metal chip 65 and the ground electrode 40 are the same as that shown in FIG. 13 regardless of the chip sectional area A'.

It is, thus, appreciated that the condition that the depth t1 of the noble metal chip 65 embedded in the groove 47*a* of the ground electrode 40 is greater than 0.5 times the width D1 (t1≧0.5D1) ensures a higher joint strength between the noble metal chip 65 and the ground electrode 40 as well as the wear resistance of the noble metal chip 65.

Figure 14:
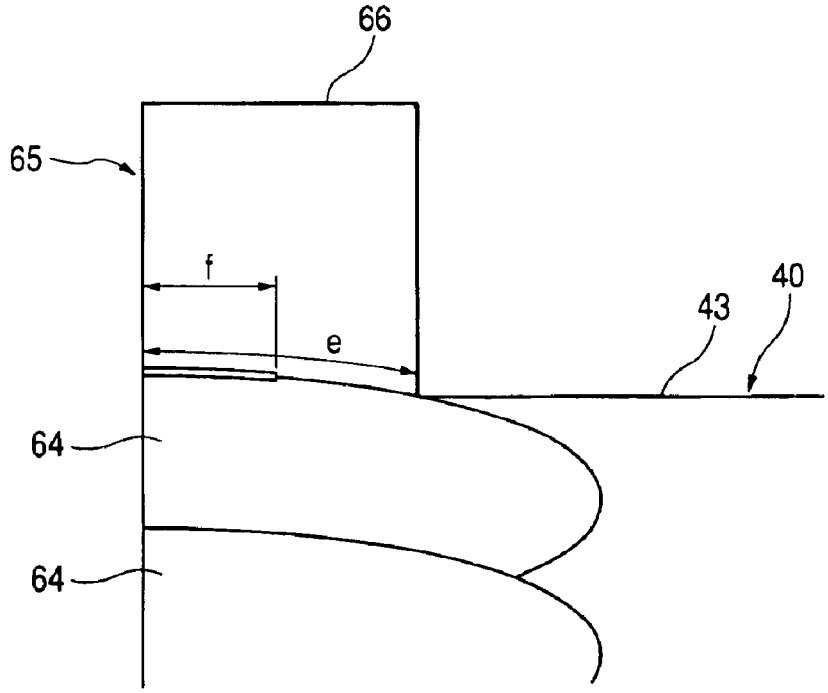
FIG. 14 is an enlarged view which shows a boundary surface between a noble metal chip and fused portions.

We also performed the durability tests using spark plug samples and evaluated the joint reliability by measuring the chip sectional area A', the melt depth H, and the melt width N in order to improve the ignitability of fuel and the joint strength between the noble metal chip 65 and the ground electrode 40. We found the joint reliability as a function of a separation percentage of the noble metal chip 65 which is, as shown in FIG. 14, expressed by (f/e)×100(%) where f is a separated length of a boundary area between the noble metal chip 65 and the fused portion 64, and e is a joined length thereof and determined that when the separation percentage is less than or equal to 25%, the joint reliability is sufficient for ensuring desired performance of the spark plug 100.

Figure 15:
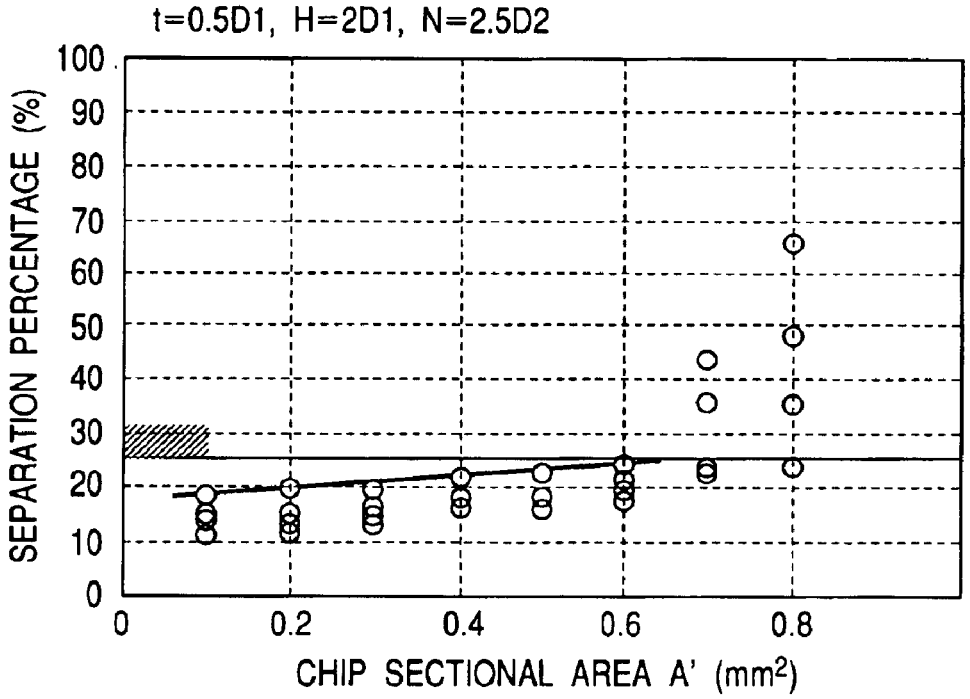
FIG. 15 is a graph which shows a relation between a separation percentage of a boundary area between a noble metal chip and a ground electrode and a chip sectional area A', as shown in FIG. 12(*b*)

First, we performed the durability tests on the spark plug samples and confirmed, as shown in FIG. 15, the effects of the chip sectional area A' on the joint reliability. In each spark plug sample, the noble metal chip 65 is made of an Ir-10Rh cylindrical member having a length of 0.8 mm. The ground electrode 40 is identical with that used in the durability tests as shown in FIG. 13. The embedded depth t1 of the noble metal chip 65 is 0.5D1. The melt depth His 2D1. The melt width N is 2.5D2. We used the four spark plug samples for each chip sectional area A'.

FIG. 15 illustrates a relation between the chip sectional area A' ($mm^2$) and the separation percentage (%) and shows that when the chip sectional area A' is between 0.1 $mm^2$ and 0.6 $mm^2$ (0.1 $mm^2 \leqq A' \leqq 0.6$ $mm^2$), the separation percentage is less than or equal to 25%, thus ensuring a higher degree of reliability of the joint between the noble metal chip 65 and the ground electrode 40, but when the chip sectional area A' exceeds 0.6 $mm^2$, it results in a great variation in separation percentage, so that the joint reliability is lowered. This is because an increase in chip sectional area A' results in a increase in thermal capacity of the noble metal chip 65, thus causing the thermal stress added to the boundary surface between the chip 65 and the fused portions 64 to increase. Conversely, when the chip sectional area A' is smaller than 0.1 $mm^2$, the noble metal chip 65 is too thin to be practical for the same reasons as discussed in the first embodiment.

It is, thus, found that the use of the noble metal chip 65 whose chip sectional area A' lies within a range of 0.1 $mm^2$ to 0.6 $mm^2$ (0.1 $mm^2 \leqq A' \leqq 0.6$ $mm^2$) provides a higher degree of reliability of the joint between the noble metal chip 65 and the ground electrode 40 and that the thin noble metal chip 65 ensures a higher degree of ignitability of a fuel.

We also performed durability tests using spark plug samples and researched the effects of the melt depth H and the melt width N of the fused portions 64 on the joint reliability. The noble metal chip 65 used in each of the spark plug samples is made of an Ir-10Rh cylindrical member which has a diameter of 0.88 mm (=D1=D2, the chip sectional area A'=0.6 $mm^2$) and a length L of 0.8 mm. The ground electrode 40 is identical with that used in the durability tests of FIG. 13. The embedded depth t1 of the noble metal chip 65 is 1.0D1.

Figure 16:
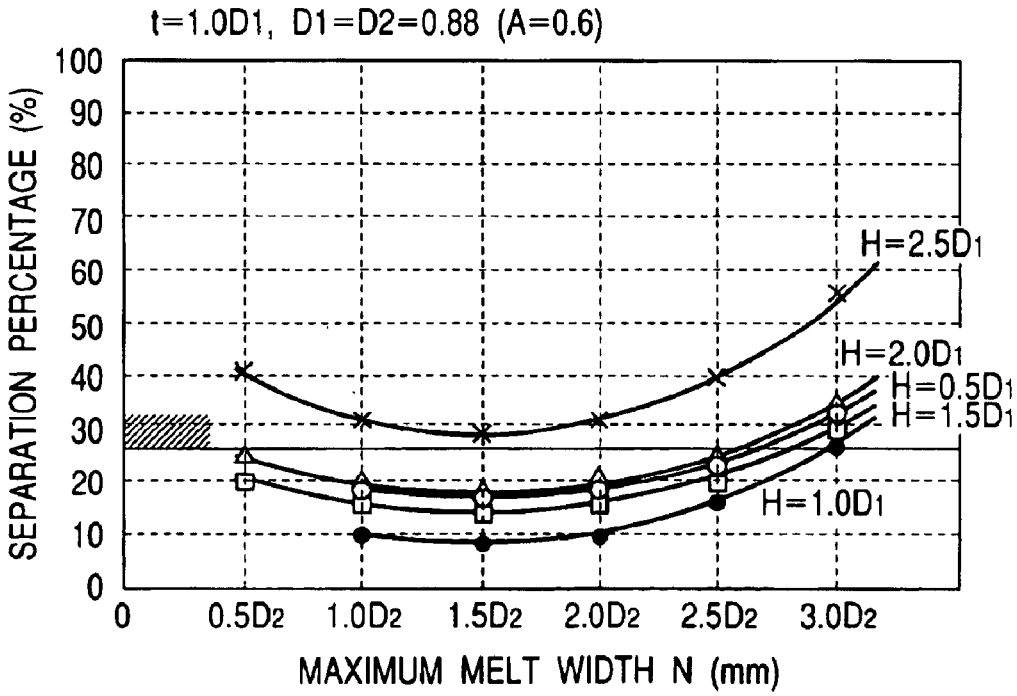
FIG. 16 is a graph which shows a relation between a separation percentage of a boundary area between a noble metal chip and a ground electrode and a maximum melt width N, as shown in FIG. 12(*b*), for different values of melt depth H, as shown in FIG. 12(*a*)
Figure 17A:
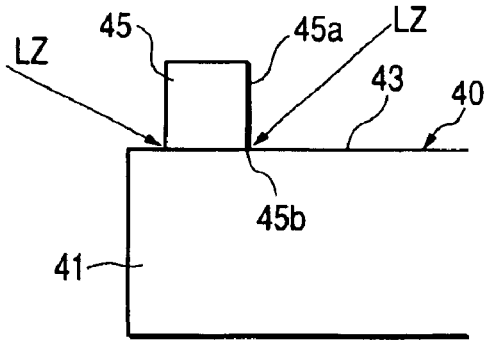
FIG. 17(*a*) is a side view which shows a noble metal chip to be welded to a ground electrode by laser beams radiated at different angles in a modified form of the first embodiment.
Figure 17C:
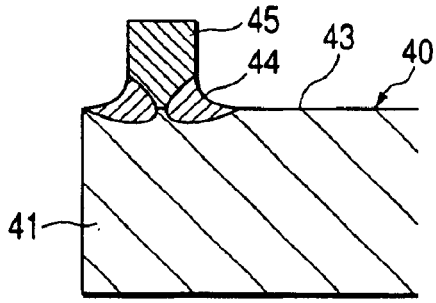
Figure 17B:
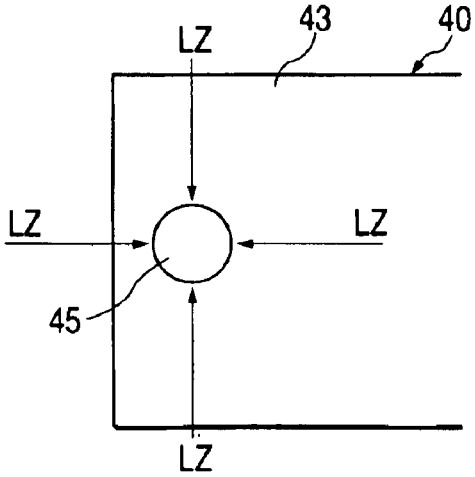
Figure 17D:
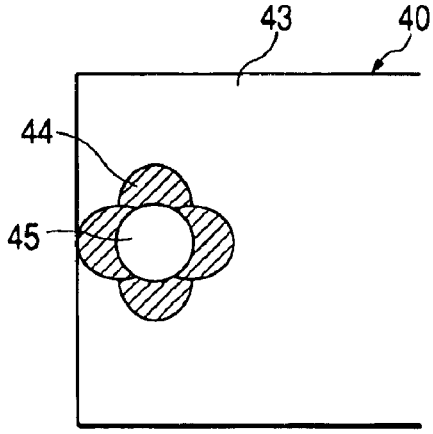
Figure 18A:
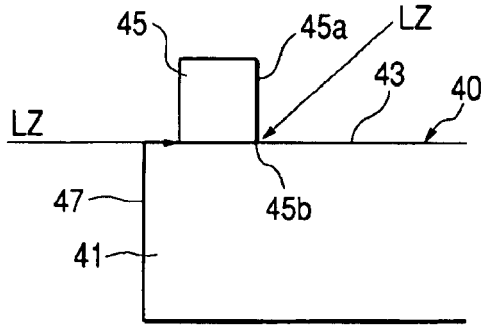
FIG. 18(*a*) is a side view which shows a noble metal chip to be welded to a ground electrode by laser beams radiated at different angles in the second modified form of the first embodiment.
Figure 18C:
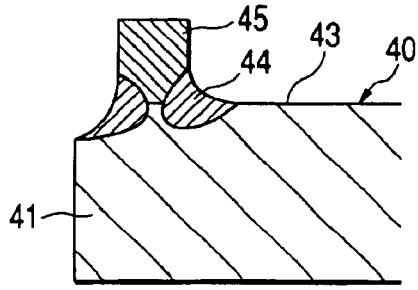
Figure 18B:
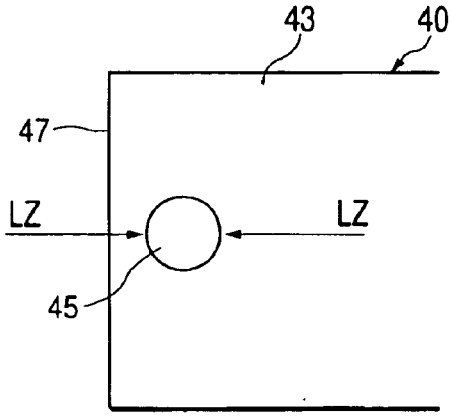
Figure 18D:
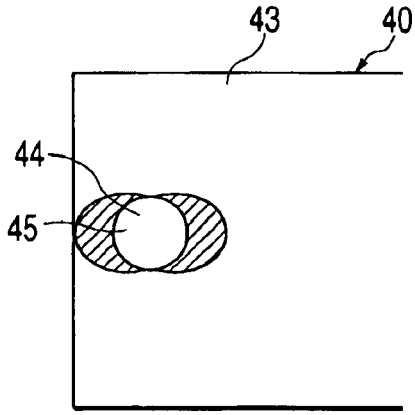
Figure 19A:
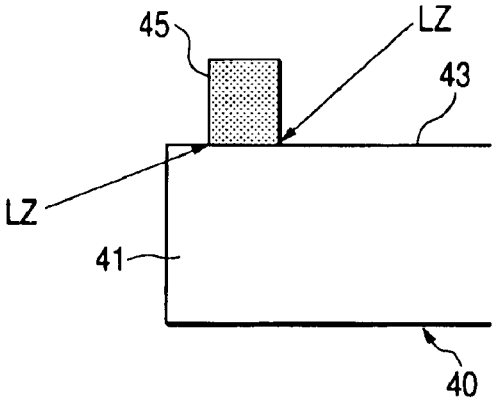
FIG. 19(*a*) is a side view which shows a noble metal chip to be welded to a ground electrode by laser beams radiated at different angles in the third modified form of the first embodiment.
Figure 19C:
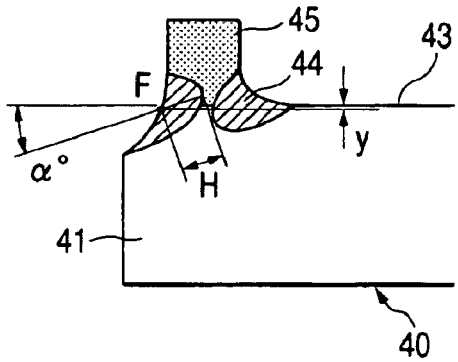
Figure 19B:
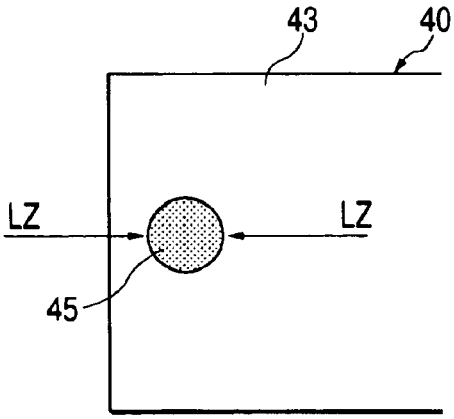
Figure 19D:
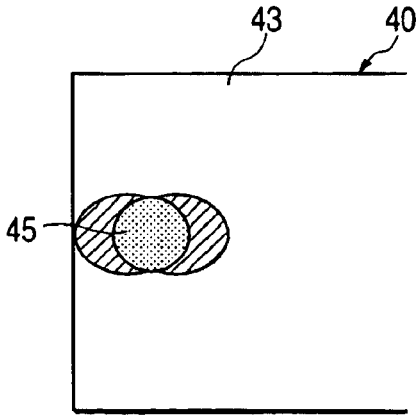
Figure 20A:
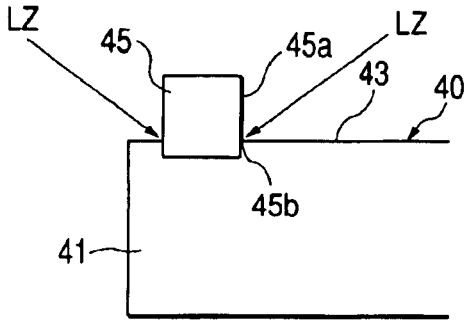
FIG. 20(*a*) is a side view which shows a structure of a joint between a noble metal chip and a ground electrode in a modified form of the first embodiment.
Figure 20C:
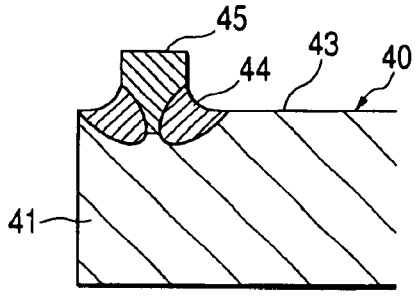
Figure 20B:
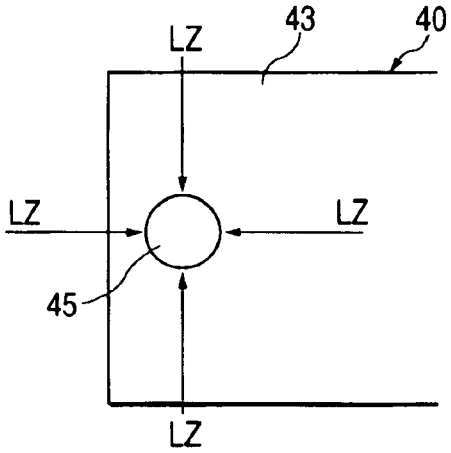
Figure 20D:
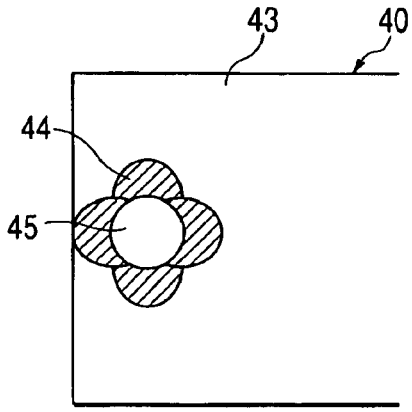
Figure 21A:
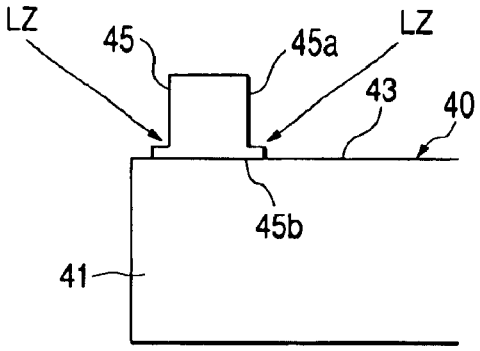
FIG. 21(*a*) is a side view which shows a structure of a joint between a noble metal chip and a ground electrode in the second modified form of the first embodiment.
Figure 21C:
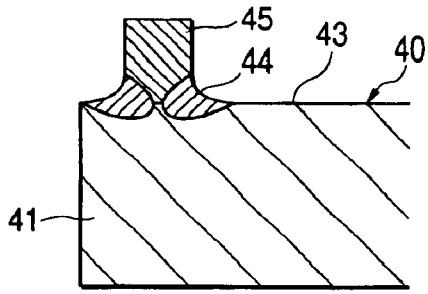
Figure 21B:
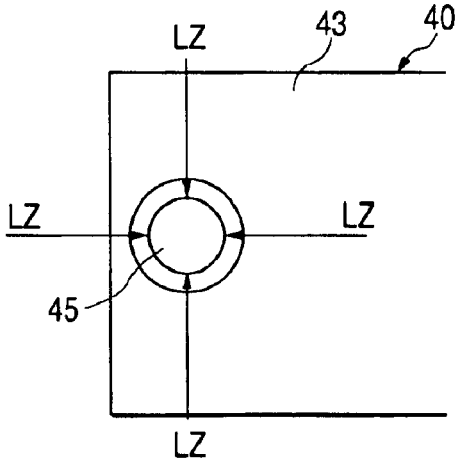
Figure 21D:
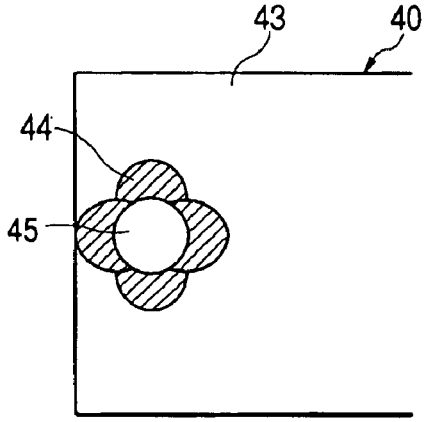
Figure 22A:
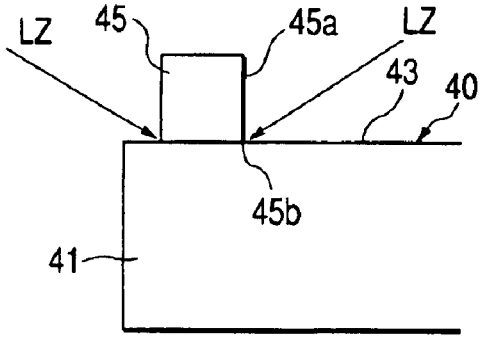
FIG. 22(*a*) is a side view which shows a modified shape of a noble metal chip to be welded to a ground electrode.
Figure 22C:
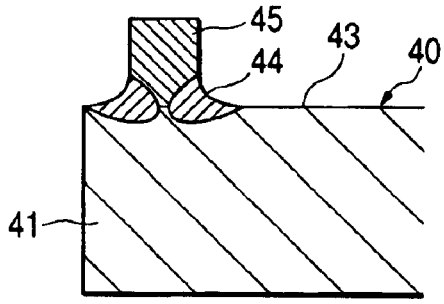
Figure 22B:
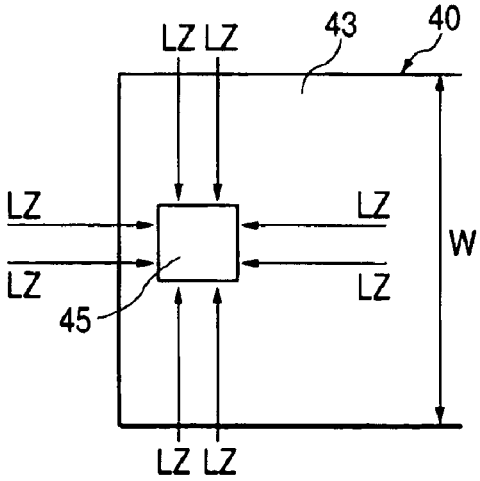
Figure 22D:
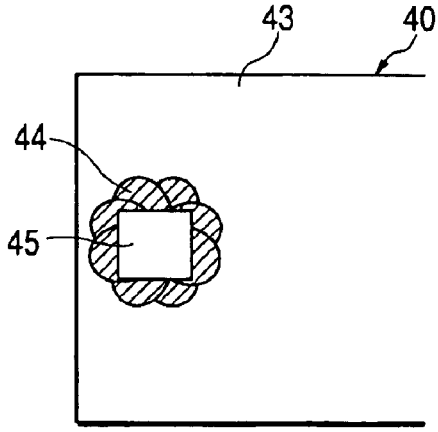
Figure 23A:
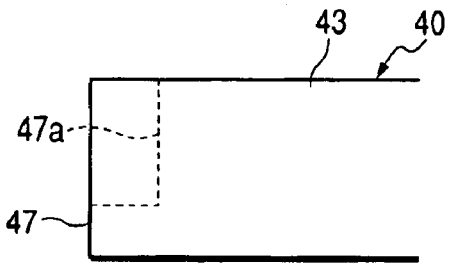
FIGS. 23(*a*), 23(*b*), 23(*c*), 23(*d*), and 23(*e*) show modifications of a groove in which a noble metal chip is embedded in the second embodiment of the invention.
Figure 23C:
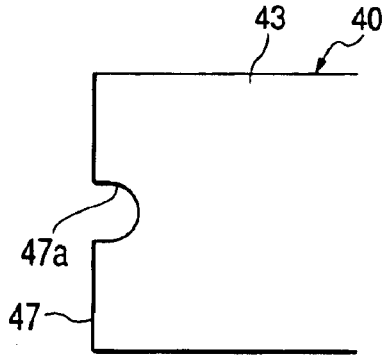
Figure 23D:
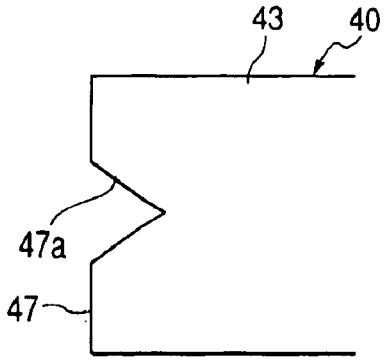
Figure 23B:
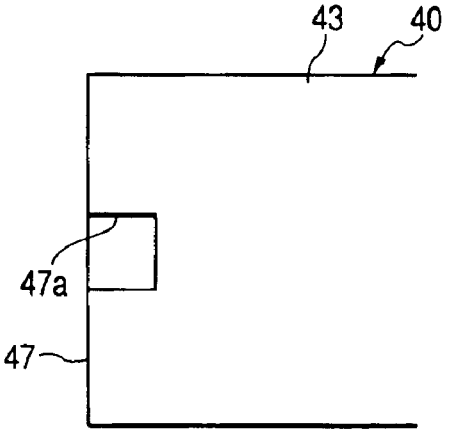
Figure 23E:
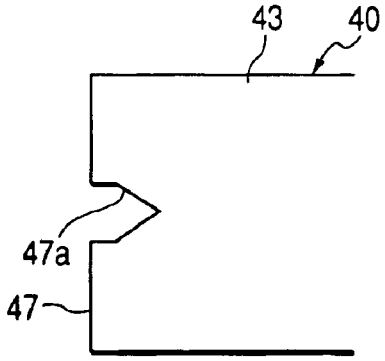
Figure 24A:
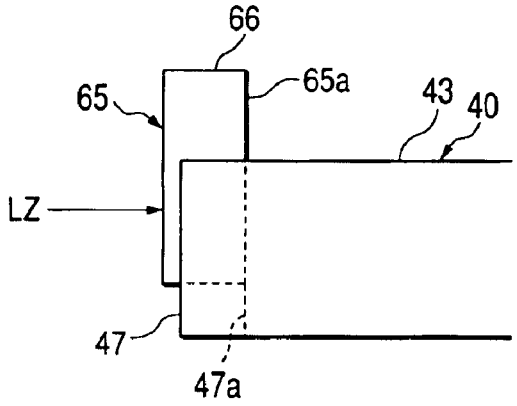
FIG. 24(*a*) is a side view which shows a modified method of welding a noble metal chip to a ground electrode using a single laser beam in the second embodiment of the invention.
Figure 24C:
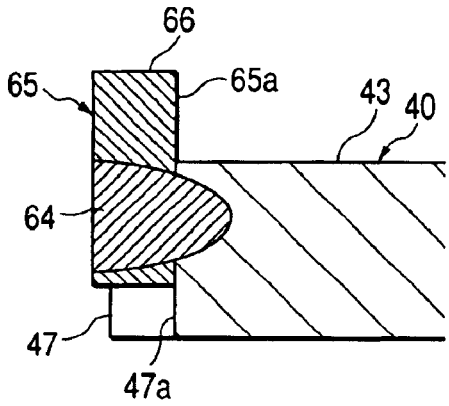
Figure 24B:
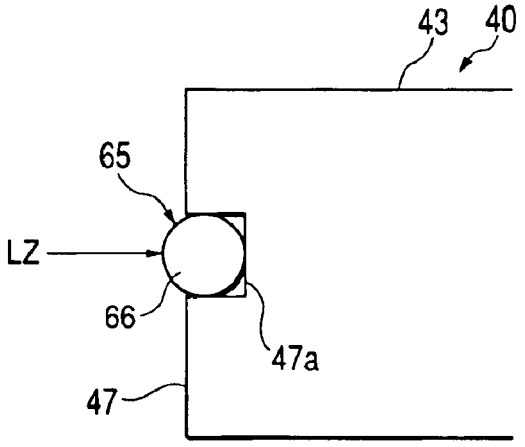
Figure 24D:
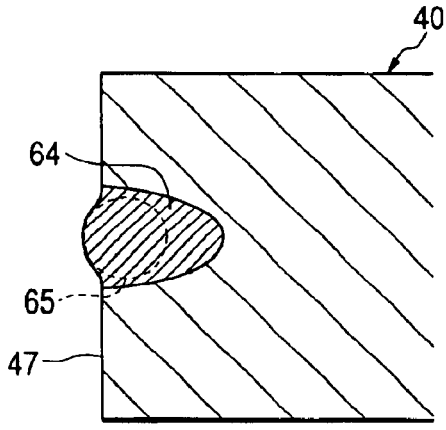
Figure 25A:
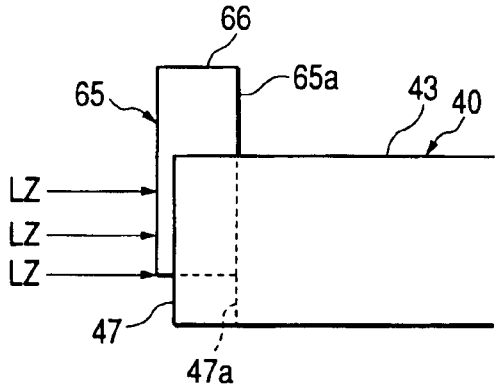
FIG. 25(*a*) is a side view which shows the second modified method of welding a noble metal chip to a ground electrode using a single laser beam in the second embodiment of the invention.
Figure 25C:
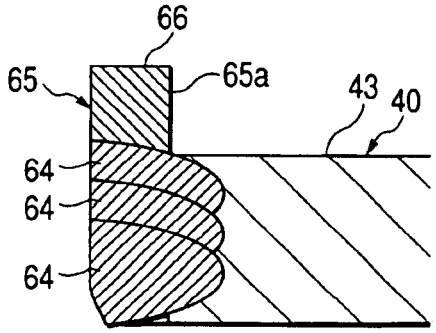
Figure 25B:
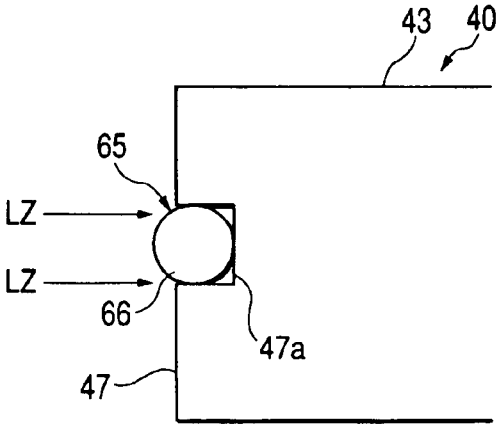
Figure 25D:
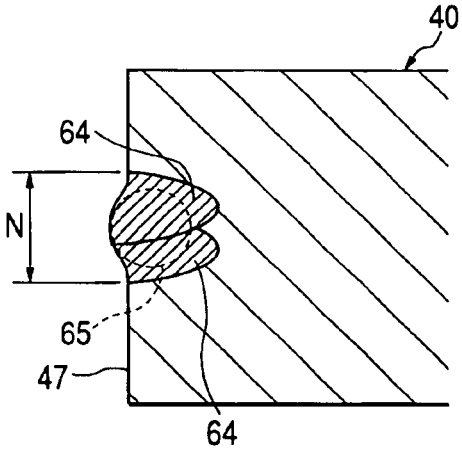
Figure 26A:
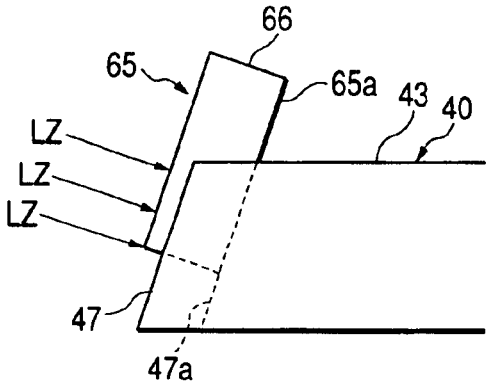
FIG. 26(*a*) is a side view which shows a modified form of a tip of a ground electrode to which a noble metal chip is welded in the second embodiment of the invention.
Figure 26B:
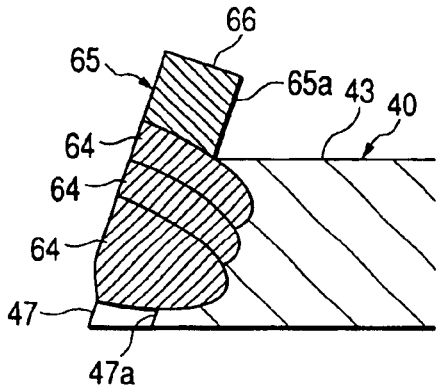
Figure 26C:
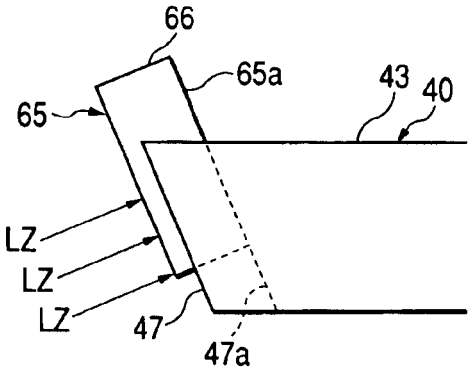
Figure 26D:
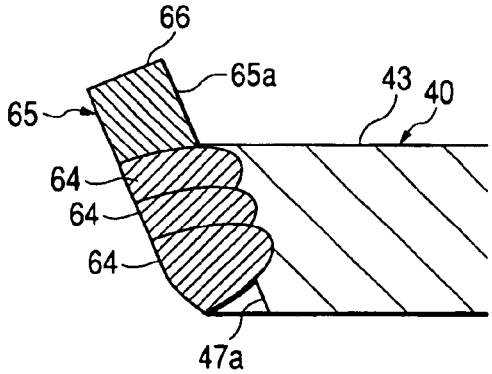
Figure 27A:
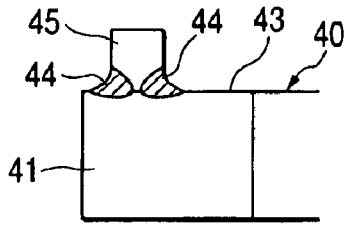
FIGS. 27(*a*), 27(*b*), 27(*c*), and 27(*d*) show modified forms of a tip of a ground electrode in the first embodiment of the invention in order to decrease thermal stress added to a joint between a noble metal chip and the ground electrode.
Figure 27C:
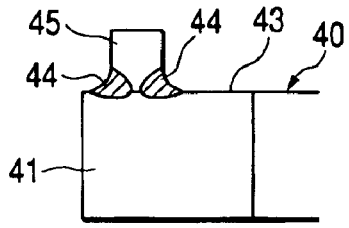
Figure 27B:
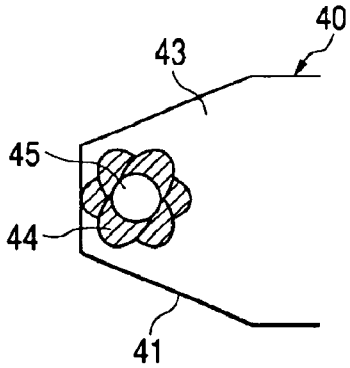
Figure 27D:
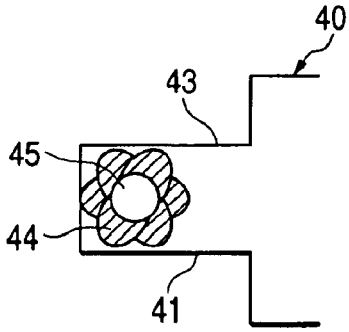
Figure 27E:
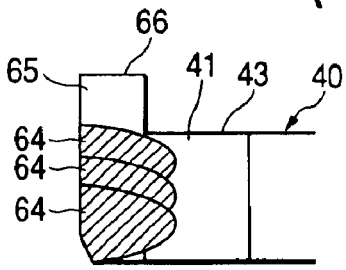
Figure 27G:
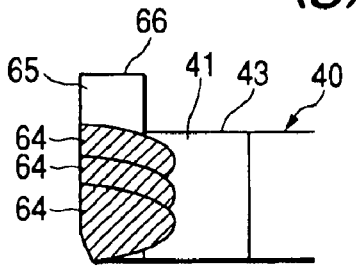
Figure 27F:
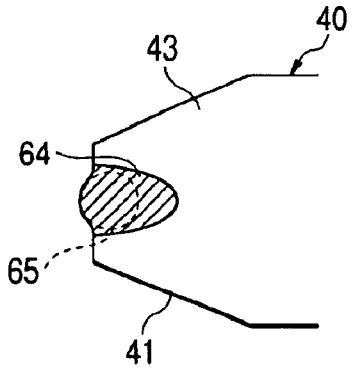
Figure 27H:
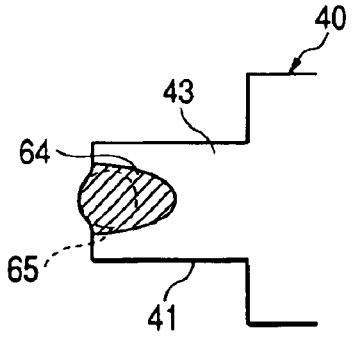

FIG. 16 represents a relation between the separation percentage (%) and the melt width N (mm) that is a multiple of the width D2 of the noble metal chip 65 when the melt depth H is changed in units of 0.5 times the width D1 within a range of 0.5 D1 and 2.5D1. We used the six spark plug samples for each melt depth H and each melt width N and plotted one of them showing the greatest separation percentage in the graph of FIG. 16.

The graph shows that when the melt depth H is less than or equal to 2.0D1, it is possible to decrease the separation percentage below 25% for ensuring a higher degree of reliability of the joint between the noble metal chip 65 and the ground electrode 40, but when the melt depth His greater than 2.0D1, it results in a great increase in separation percentage, so that the joint reliability is lowered.

Specifically, when the melt depth H is less than or equal to 2.0D1, and the melt width N is less than or equal to 2.5D2, the separation percentage will be less than or equal to 20%, while when the melt with N exceeds 2.5D2, it will cause the separation percentage to exceeds 20%, thus resulting in lowered reliability of the joint between the noble metal chip 65 and the ground electrode 40. This is because the increasing of the melt depth H and the melt width N will cause a ratio of material of the chip 65 to material of the ground electrode 40 in the fused portions 64, that is, an Ir alloy content of the fused portions 64 to decrease, so that a difference in linear expansion coefficient between the chip 65 and the fused portions 64 decreases, thus resulting in an increase in thermal stress acting on the boundary surfaces between the chip 65 and the fused portions 64.

FIGS. 17(*a*) to 22(*d*) show modifications of the joint of the noble metal chip 45 and the ground electrode 40 in the first embodiments.

In the first embodiment, the laser beams are radiated at the same angle to the boundary between the noble metal chip 45 and the ground electrode 40, but they may alternatively be, as indicated by arrows LZ in FIGS. 17(*a*), 17(*b*), 18(*a*), and 18(*b*), oriented at different angles to the inner side surface 43 of the ground electrode 40. In the case as illustrated in FIGS. 18(*a*) to 18(*d*), the laser beam emitted from outside the end surface 47 of the ground electrode 40 is oriented perpendicular to the length of the noble metal chip 45 (i.e., 0° to the inner side surface 43 of the ground electrode 40). In the case as illustrated in FIGS. 19(*a*) to 19(*d*), the laser beam emitted from outside the end surface 47 of the ground electrode 40 is oriented at an angle $\alpha$ of −20° to the inner side surface 43 of the ground electrode 40.

The noble metal chip 45 may be, as shown in FIGS. 20(*a*) to 20(*d*), embedded in a recess 45*b* formed in the inner side surface 43 of the ground electrode 40 and then laser-welded.

The noble metal chip 45 may be, as shown in FIGS. 21(*a*) and 21(*b*), made of a flanged cylindrical member such as a rivet.

The noble metal chip 45 may be made of a polygonal pole such as a square pole shown in FIGS. 22(*a*) and 22(*b*), a triangular pole, or an oval pole, a disc, a polygonal plate, or a pole having a plurality of shoulders. The number of welds or laser beams may be selected depending upon the size and/or shape of the noble metal chip 45.

In the second embodiment, the groove 47*a* in which the noble metal chip 65 is embedded extends through a thickness of the ground electrode 40, but, as shown in FIG. 23(*a*), may not reach the outer side surface of the ground electrode 40 opposite the inner side surface 43. The shape of a sectional area of the groove 47*a* may be, as shown in FIGS. 23(*b*), 23(*c*), 23(*d*), and 23(*e*), square, semi-circular, triangular, or pentagonal.

FIGS. 24(*a*) to 26(*d*) illustrate modification of the joint of the noble metal chip 65 and the ground electrode 40 in the second embodiment.

The number of welds or laser beams radiated to the noble metal chip 65 may be changed depending upon the size or shape of the noble metal chip 65. For instance, a single laser beam, as shown in FIGS. 24(*a*) and 24(*b*), may be used to weld the noble metal chip 65 to the ground electrode 40. Alternatively, parallel laser beams which are spaced, as can be seen in FIG. 25(*b*), laterally of the noble metal chip 65 may be radiated to contacts between a peripheral wall of the noble metal chip 65 and an inner wall of the groove 47*a*. In this case, the melt width H is, as clearly shown in FIG. 25(*d*), is a total width of the two fused portions 64 partially overlapped in a widthwise direction of the ground electrode 40.

The end surface 47, as shown in FIG. 26(*a*) and 26(*b*) or 26(*c*) and 26(*d*), may be tapered. In either case, the noble metal chip 65 is inclined at a given angle to the inner side surface 43 of the ground electrode 40.

FIGS. 27(*a*) to 27(*h*) illustrate modifications of the shape of the tip 41 of the ground electrode 40 in order to decrease the thermal stress added to the joint of the noble metal chip 45 or 65 and the ground electrode 40 . In the modifications shown in FIGS. 27(*a*) to 27(*d*), the tip 41 of the ground electrode 40 is narrower than the body thereof, thereby decreasing the thermal stress acting on the ground electrode 40, thus resulting in a decrease in thermal stress at the boundary between the noble metal chip 45 and the ground electrode 40. The same is true for the modifications of the second embodiment as shown in FIGS. 27(*e*) to 27(*h*).

Figure 28A:
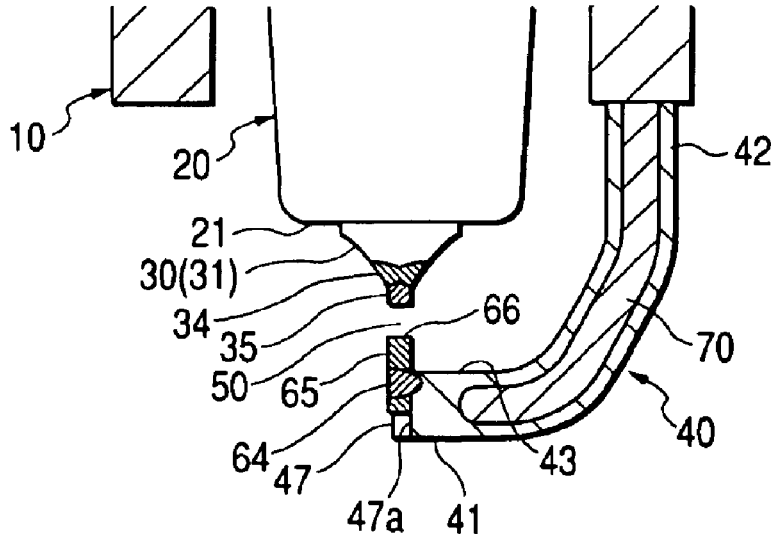
FIG. 28(*a*) is a partially sectional view which shows a modification of an internal structure of a ground electrode in the second embodiment of the invention.
Figure 28B:
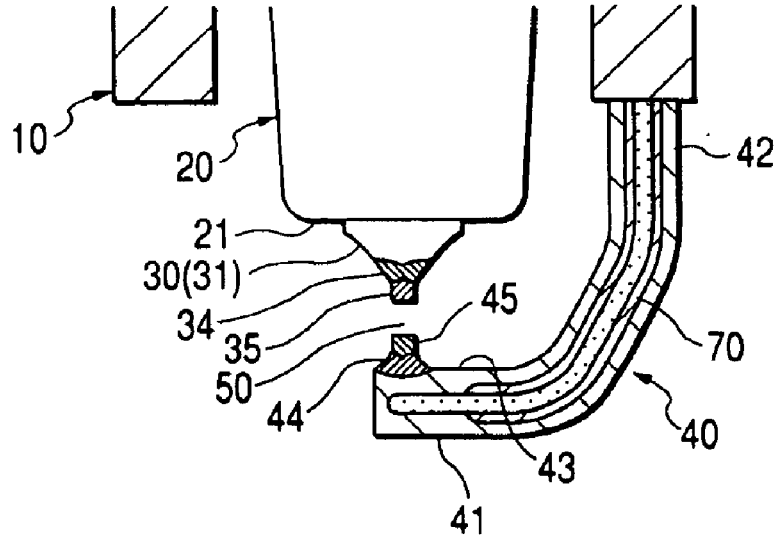

The ground electrode 40, as shown in FIGS. 28(*a*) and 28(*b*), may have an inner layer 70 which is made of material having a thermal conductivity higher than that of a base material (e.g., a Ni-base alloy) of the ground electrode 40. This results in a decrease in temperature rise at the tip 41 or the joint of the noble metal chip 45 or 65 and the ground electrode 40, thereby lowering the thermal stress added to the boundary surface between the noble metal chip 45 or 65 and the ground electrode 40. In the case of FIG. 28(*a*), the inner layer 70 is made from Cu. In the case of FIG. 28(*b*), the inner layer 70 is formed by a laminate of Cu and Ni cladding.

Figure 29A:
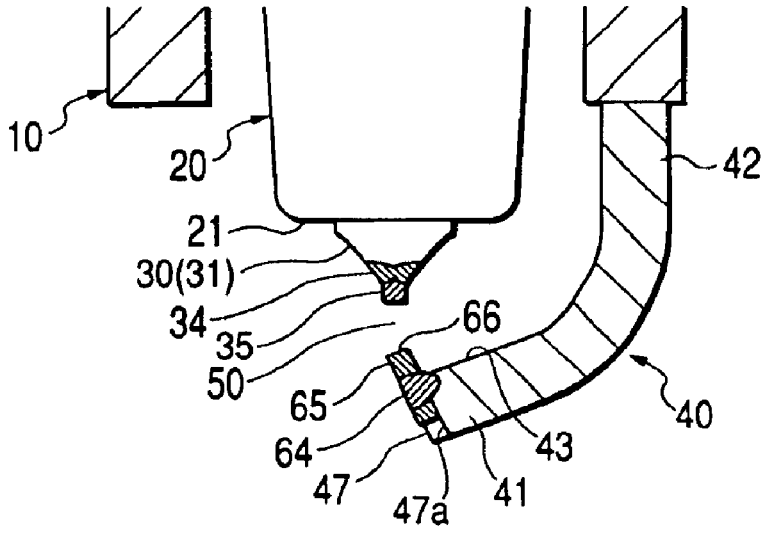
FIG. 29(*a*) is a partial side view which shows a modification of a ground electrode in the second embodiment of the invention in which the degree of bending of the ground electrode is smaller.
Figure 29B:
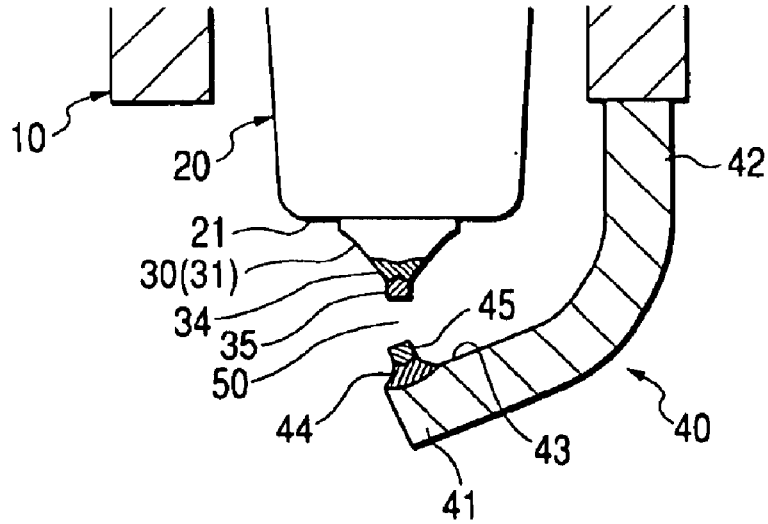

The degree of bending of the ground electrode 40, as illustrated in FIGS. 29(*a*) and 29(*b*), may be decreased to orient the noble metal chips 45 and 65 out of alignment with the noble metal chip 35 of the center electrode 30. This allows the ground electrode 40 to be shortened and results in a decrease in temperature rise at the tip 41 of the ground electrode 40, thereby lowering the thermal stress added to the boundary surface between the noble metal chip 45 or 65 and the ground electrode 40.

While the present invention has been disclosed in terms of the preferred embodiments in order to facilitate better understanding thereof, it should be appreciated that the invention can be embodied in various ways without departing from the principle of the invention. Therefore, the invention should be understood to include all possible embodiments and modifications to the shown embodiments which can be embodied without departing from the principle of the invention as set forth in the appended claims. For instance, each of the noble metal chips 35, 45, and 65 may be made from a material which contains a main component of 50 Wt % or more of Pt and an additive of at least one of Rh, Ir, Os, Ni, W, Pd, and Ru or a main component of 50 Wt % or more of Ir and an additive of at least one of Rh, Pt, Os, Ni, W, Pd, and Ru.

What is claimed is:

1. A spark plug comprising:

a center electrode having a tip;

a ground electrode having a center electrode-opposed surface facing the tip of said center electrode;

a noble metal member having a given length and a first and a second end opposed to each other through the length, said noble metal member being joined at the first end to the center electrode-opposed surface of said ground electrode by laser welding so as to oppose the second end to the tip of said center electrode through a spark gap; and a fused portion that forms a weld of said noble metal member and said ground electrode formed by materials of said ground electrode and said noble metal member melted together, wherein a sectional area of said noble metal member traversing the length thereof is greater than or equal to 0.1 $mm^2$ and smaller than or equal to 0.6 $mm^2$, wherein an unfused sectional area percentage that is a percentage of a sectional area of an unfused portion of the first end of said noble metal member within a range of a sectional area of said noble metal member closest to said fused portion traversing the length of said noble metal member is less than or equal to 50%, and wherein a melt angle that is an angle which a line extending through said fused portion along a maximum depth of said fused portion makes with the center electrode-opposed surface of said ground electrode is less than or equal to 60°.

2. A spark plug as set forth in claim 1, wherein if a point at which the line extending along the maximum depth of said fused portion intersects an outer surface of said fused portion is defined as an intersection F, and a distance between the intersection F and the center electrode-opposed surface of said ground electrode is defined as an Intersection-to-surface distance y, the intersection F is located within a range of −0.2 mm to 0.3 mm where when the intersection F is located outside the center electrode-opposed surface of said ground electrode, the intersection-to-surface distance y is expressed in a plus value (+), and when the intersection F is located inside the center electrode-opposed surface of said ground electrode, the intersection-to-surface distance y is expressed in a minus value (−), and wherein said melt angle is less than or equal to (30+100y)°.

3. A spark plug as set forth in claim 1, wherein if a width of a portion of said noble metal member closest to said fused portion is defined as D, the maximum depth of said fused portion is less than or equal to 1.4D.

4. A spark plug as set forth in claim 1, wherein said noble metal member is made from one of a first material containing a main component of 50Wt % or more of Pt and an additive of at least one of 25 Rh, Ir, Os, Ni, W, Pd, and Ru and a second material containing a main component of 50Wt % or more of Ir and an additive of at least one of Rh, Pt, Os, Ni, W, Pd, and Ru.

5. A spark plug comprising:

a metal shell;

a center electrode retained in said metal shell to be insulated from said metal shell, said center electrode having a tip exposed outside said metal shell;

a ground electrode installed on said metal shell, said ground electrode having a tip which has a center electrode-opposed side surface facing the tip of said center electrode and an end surface; and a noble metal member that is at least partially embedded in the end surface of said ground electrode and joined to said ground electrode by laser welding through a fused portion that forms a weld of said noble metal member and said ground electrode formed by materials of said ground electrode and said noble metal member melted together, said noble metal member having a tip projecting from the center electrode-opposed side surface of said ground electrode toward said center electrode so as to define a spark gap between the tip of said noble metal member and the tip of said center electrode.

6. A spark plug as set forth in claim 5, wherein if a width of a portion of said noble metal member closest to said fused portion in a direction perpendicular to the end surface of said ground electrode is defined as D1, a depth of a portion of said noble metal member embedded in the end surface of said ground electrode is greater than or equal to 0.5D1.

7. A spark plug as set forth in claim 5, wherein said noble metal chip has a length, and a sectional area of said noble metal member traversing the length thereof is greater than or equal to 0.1 $mm^2$ and smaller than or equal to 0.6 $mm^2$.

8. A spark plug as set forth In claim 5, wherein if a width of a portion of said noble metal member closest to said fused portion in a direction perpendicular to the end surface of said ground electrode is defined as D1, a width of said portion of said noble metal member in a direction parallel to the end surface of said ground electrode is defined as D2, a width of said fused portion is defined as N, and a maximum depth of said fused portion is defined as H, the maximum depth H is smaller than or equal to 2D1, and the width N is smaller than or equal to 2.5D2.

9. A spark plug as set forth in claim 8, wherein a depth of a portion of said noble metal member embedded in the end surface of said ground electrode is greater than or equal to 0.5D1.

10. A spark plug as set forth in claim 5, wherein said noble metal member is made from one of a first material containing a main component of 50Wt % or more of Pt and an additive of at least one of Rh, Ir, Os, Ni, W, Pd, and Ru and a second material containing a main component of 50Wt % or more of Jr and an additive of at least one of Rh, Pt, Os, Ni, W, Pd, and Ru.

11. A spark plug as set forth in claim 1, further comprising a metal shell having a thread formed in an outer periphery thereof, a porcelain insulator installed in said metal shell to have a tip projecting from an end of said metal shell, said porcelain insulator having a length and an inner chamber extending along the length thereof, wherein said center electrode is disposed within the inner chamber of said center electrode to have a tip projecting from the tip of said porcelain insulator, and wherein said ground electrode has an L-shape which includes a base end welded to the end of said metal shell and a tip, the tip of said ground electrode having a side surface defining the center electrode-opposed surface which faces the tip of said center electrode through the spark gap.

12. A spark plug as set forth in claim 5, further comprising a metal shell having a thread formed in an outer periphery thereof, a porcelain insulator installed in said metal shell to have a tip projecting from an end of said metal shell, said porcelain insulator having a length and an inner chamber extending along the length thereof, wherein said center electrode is disposed within the inner chamber of said center electrode to have a tip projecting from the tip of said porcelain insulator, and wherein said ground electrode has an L-shape which includes a base end welded to the end of said metal shell and a tip, the tip of said ground electrode having a side surface defining the center electrode-opposed surface which faces the tip of said center electrode through the spark gap.

13. A spark plug comprising:

a center electrode having a tip;

a ground electrode having a center electrode-opposed surface facing the tip of said center electrode;

a noble metal member having a given length, a first end joined to the ground electrode by laser welding and a second end having an end face defining a spark gap with the tip of said center electrode; and a fused portion that forms a weld of said noble metal member and said ground electrode formed by materials of said ground electrode and said noble metal member melted together, wherein a sectional area of said noble metal member traversing the length thereof is greater than or equal to 0.1 $mm^2$ and smaller than or equal to 0.6 $mm^2$, wherein an unfused sectional area percentage that is a percentage of a sectional area of an unfused portion of the first end of said noble metal member within a range of a sectional area of said noble metal member closest to said fused portion traversing the length of said noble metal member is less than or equal to 50%, and wherein a melt angle that is an angle which a line extending through said fused portion along a maximum depth of said fused portion makes with the center electrode-opposed surface of said ground electrode is less than or equal to 60°.

14. A spark plug as set forth in claim 13, wherein a longitudinal axis of the noble metal member laser welded to the ground electrode is disposed so as to be substantially perpendicular to the center electrode-opposed surface of said ground electrode.

15. A spark plug as set forth in claim 13, wherein a longitudinal axis of the noble metal member laser welded to the ground electrode is disposed at an angle of less than 90° with respect to a plane of said center electrode-opposed surface of said ground electrode.

16. A spark plug as set forth in claim 13, wherein a longitudinal axis of the noble metal member laser welded to the ground electrode is disposed at an angle greater than 90° with respect to a plane of said center electrode-opposed surface of said ground electrode.

17. A spark plug as set forth in claim 13, wherein said first end of said noble metal member is laser welded to said center electrode-opposed surface of said ground electrode so as to project therefrom towards said tip of said center electrode.

18. A spark plug as set forth in claim 13, wherein said noble metal member is laser welded to a distal end surface of said ground electrode.

19. A spark plug as set forth in claim 18, wherein said ground electrode has a groove formed in said distal end surface thereof and extending in a thickness-wise direction of the ground electrode toward the center electrode, said noble metal member being disposed at least partially within said groove with said second end projecting beyond said center electrode-opposed surface of said ground electrode and said noble metal member is laser welded to said groove.

20. A spark plug as set forth in claim 18, wherein if a width of a portion of said noble metal member closest to said fused portion in a direction perpendicular to the end surface of said ground electrode is defined as D1, a depth of a portion of said noble metal member embedded in the end surface of said ground electrode is greater than or equal to 0.5D1.

* * * * *